US009862538B2

(12) United States Patent
Pham et al.

(10) Patent No.: US 9,862,538 B2
(45) **Date of Patent: *Jan. 9, 2018**

(54) MOBILE ERECTOR SYSTEM

(71) Applicant: SCHLUMBERGER TECHNOLOGY CORPORATION, Sugar Land, TX (US)

(72) Inventors: Hau Nguyen-Phuc Pham, Houston, TX (US); Christopher Todd Shen, Houston, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 131 days.

This patent is subject to a terminal disclaimer.

(21) Appl. No.: 14/560,392

(22) Filed: Dec. 4, 2014

(65) Prior Publication Data

US 2015/0166260 A1 Jun. 18, 2015

Related U.S. Application Data

(60) Provisional application No. 61/915,323, filed on Dec. 12, 2013.

(51) Int. Cl.
*B65G 3/04* (2006.01)
*B65D 88/30* (2006.01)
(Continued)

(52) U.S. Cl.
CPC ..... *B65D 88/30* (2013.01); *B65D 88/32* (2013.01); *B65D 88/54* (2013.01); *B65D 90/12* (2013.01); *B65D 90/48* (2013.01)

(58) Field of Classification Search
CPC ..... B65D 88/30; B65D 88/32; B65D 90/12; B65D 90/125; B28C 7/0084;
(Continued)

(56) References Cited

U.S. PATENT DOCUMENTS 6,527,428 B2 * 3/2003 Guntert, Jr. ..... B28C 9/0418 366/2
7,214,028 B2 * 5/2007 Boasso ..... B28C 7/0084 414/812

(Continued)

*Primary Examiner* — Anna Momper
*Assistant Examiner* — Mark Hageman
(74) *Attorney, Agent, or Firm* — Michael L. Flynn; Rachel E. Greene; Robin Nava

(57) ABSTRACT

A mobile support structure (MSS) includes a frame structure for receiving modular silos, a base moveable between transportation and support configurations, and connectors coupling with the silos. A mobile erecting assembly includes a chassis, a lift structure rotatable between transportation and mounting orientations while engaged with a silo, an engagement structure movable between first and second positions while engaged with the silo, and an actuator to move the engagement structure and silo between the first and second positions. The silo is connected to the mobile erector assembly in the transportation orientation, and the mobile erector assembly is then aligned relative to the MSS, such as by engaging an alignment member of the mobile erector assembly with a chassis alignment post of the MSS. The mobile erector assembly is then operated to move the silo to the mounting orientation, and the silo is then coupled to the MSS.

10 Claims, 21 Drawing Sheets

(51) Int. Cl.

| | |
|---|---|
| ***B65D 88/32*** | (2006.01) |
| ***B65D 88/54*** | (2006.01) |
| ***B65D 90/12*** | (2006.01) |
| ***B65D 90/48*** | (2006.01) |

(58) Field of Classification Search
CPC ... B28C 7/0495; B28C 9/0418; B28C 9/0427; B65G 7/30; B65G 9/006; B65G 7/24; E04H 7/22; Y10S 414/132
USPC ..... 414/332, 919
See application file for complete search history.

(56) References Cited

U.S. PATENT DOCUMENTS

| | | | | |
|---|---|---|---|---|
| 8,926,252 | B2 * | 1/2015 | McIver | B60P 1/6427 414/332 |
| 2014/0041317 | A1 * | 2/2014 | Pham | E21B 15/00 52/69 |
| 2014/0041319 | A1 * | 2/2014 | Pham | E21B 15/00 52/143 |
| 2014/0041322 | A1 * | 2/2014 | Pham | E21B 15/00 52/194 |
| 2015/0044003 | A1 * | 2/2015 | Pham | B65D 88/32 414/332 |
| 2015/0166135 | A1 * | 6/2015 | Pham | B65G 67/30 414/812 |

* cited by examiner

MOBILE ERECTOR SYSTEM

CROSS-REFERENCE TO RELATED APPLICATIONS

This application claims the benefit of U.S. Provisional Application No. 61/915,323, entitled "MOBILE ERECTOR SYSTEM," filed Dec. 12, 2013, the entire disclosure of which is hereby incorporated herein by reference.

BACKGROUND OF THE DISCLOSURE

To facilitate the recovery of hydrocarbons from oil and gas wells, the subterranean formations surrounding such wells can be hydraulically fractured. Hydraulic fracturing may be used to create cracks in subsurface formations to allow oil and/or gas to move toward the well. The formation is fractured by introducing a specially engineered fluid, sometimes referred to as fracturing fluid or fracturing slurry, at high pressure and high flow rates into the formation through one or more wellbores. The fracturing fluids may be loaded with proppant, which are sized particles that may be mixed with the liquids of the fracturing fluid to help form an efficient conduit for production of hydrocarbons from the formation to the wellbore. Proppant may comprise naturally occurring sand grains or gravel, man-made proppants (e.g., fibers or resin-coated sand), high-strength ceramic materials (e.g., sintered bauxite), and/or other suitable materials. The proppant collects heterogeneously or homogeneously inside the fractures to prop open the fractures formed in the formation.

At the wellsite, proppant and other fracturing fluid components are blended at a low-pressure side of the pumping system. The oilfield materials often are delivered from storage facilities to a blender by pneumatic systems, which use air to convey the oilfield materials. Water and/or other liquids are then added, and the resulting fracturing fluid is delivered downhole under high pressure. Handling the proppant prior to blending may include transporting the proppant to the wellsite via trucks, then to holding silos or bins, and subsequently to the blending equipment. Prior to blending, the proppant handling and dispensing assemblies are assembled at the wellsite from equipment transported by trucks.

SUMMARY OF THE DISCLOSURE

This summary is provided to introduce a selection of concepts that are further described below in the detailed description. This summary is not intended to identify indispensable features of the claimed subject matter, nor is it intended for use as an aid in limiting the scope of the claimed subject matter.

The present disclosure introduces a mobile support structure (MSS) that includes a trailer-mounted support base, a frame structure connected to and extending above the support base to define silo-receiving regions each able to receive a corresponding modular silo, and an extendable base moveable between a transportation configuration and a support configuration. The MSS also includes silo connectors each disposed on the extendable base to couple with a corresponding modular silo.

The present disclosure also introduces an apparatus that includes a mobile chassis, a lift structure coupled to the chassis and rotatable between a transportation orientation and a mounting orientation while detachably engaged with a modular silo, and a positioning assembly carried by the lift structure. The positioning assembly includes an engagement structure movable between a first position and a second position while detachably engaged with the modular silo, as well as an actuator coupled between the lift structure and the engagement structure to move the engagement structure between the first position and the second position, thereby moving the modular silo engaged by the engagement structure, including lifting the modular silo away from the chassis when the lift structure is in the mounting orientation.

The present disclosure also introduces a method that includes coupling a modular silo to a mobile erector assembly of an oilfield material container transport assembly in a transportation orientation. The mobile erector assembly is then aligned relative to a mobile support structure (MSS) by engaging an alignment member of the mobile erector assembly with a chassis alignment post of the MSS. The mobile erector assembly is then operated to move the modular silo from the transportation orientation to a mounting orientation and couple the modular silo to the MSS.

These and additional aspects of the present disclosure are set forth in the description that follows, and/or may be learned by a person having ordinary skill in the art by reading the materials herein and/or practicing the principles described herein. At least some aspects of the present disclosure may be achieved via means recited in the attached claims.

BRIEF DESCRIPTION OF THE DRAWINGS

The present disclosure is understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
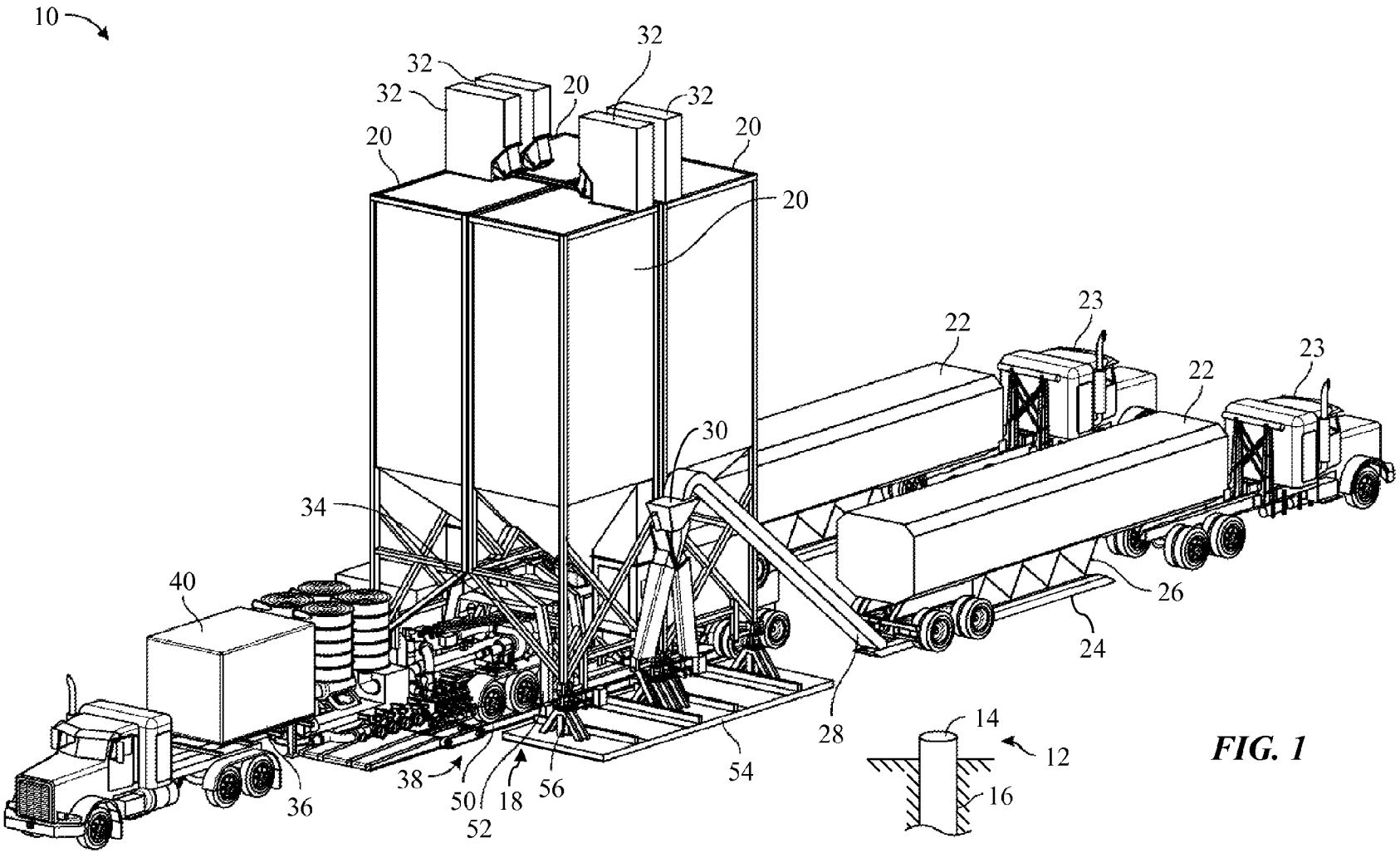
FIG. 1 is a perspective view of at least a portion of apparatus according to one or more aspects of the disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for simplicity and clarity, and does not in itself dictate a relationship between the various embodiments and/or configurations discussed. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact.

The present disclosure generally introduces a system and methodology to facilitate handling of oilfield material using mobile structures. In some implementations, modular silos for holding the oilfield material may be transported to a wellsite by suitable trucks. The modular silos may be carried to the wellsite by an over-the-road truck before being erected and mounted in a generally upright position on a mobile support structure (MSS). Once transported to the wellsite, the modular silos may be erected onto the MSS via operation of a mobile erector assembly on the truck. In the context of the present disclosure, a truck refers to a transport vehicle, such as an articulated truck having a trailer pulled by a tractor, in which example the modular silo is carried by the trailer of the truck. However, although not illustrated as such in the figures described below, the truck may also be a straight truck or other suitable truck operable to transport the modular silo over public roadways. The trailer, chassis, and/or other portion of the truck may include the mobile erector assembly operable to erect the modular silo in conjunction with mounting the modular silo on the MSS, such as via operation of various hydraulic cylinders, winches, and/or other actuator assemblies.

The chassis may include various displacement mechanisms operable for aligning the modular silo with the MSS despite the presence of misalignment between the modular silo and the MSS. For example, the mobile erector assembly may comprise one or more positioning assemblies operable to lift and/or lower the modular silo and to at least partially align the modular silo with the MSS. When the modular silo has been aligned with the MSS and erected to the mounting orientation, the positioning assemblies may lower the modular silo onto the MSS and disengage from the modular silo, thereby mounting the modular silo on the MSS.

The MSS may be operable to permit the modular silo to be erected from its transportation orientation on the mobile erector assembly to a mounting (e.g., vertical) orientation at the wellsite for mounting the modular silo on the MSS. The MSS may permit fully integrated gel-processing/slurry-blender units to be transported (e.g., driven) into the MSS, such as under the mounted modular silos, and thereafter receive oilfield materials directly from the modular silos through gravity feed.

An example implementation introduced in the present disclosure includes an oilfield material container transport assembly having a mobile erector assembly and a silo sized for over-the-road transport by the mobile erector assembly. The mobile erector assembly may have a chassis and an erecting mast. The chassis may have a first end, a second end, and a support beam extending between the first end and the second end. The erecting mast may have a lift structure with a first end, a second end, a first side, and a second side. The lift structure may be movably coupled to the chassis proximate the second end of the chassis. The lift structure may move from a transport orientation to a mounting orientation. The lift structure may be sized and dimensioned to support the silo in the transport orientation. The erecting mast may have a plurality of first retaining structures. The silo may have an outer housing and a silo frame. The housing may have at least one sidewall defining a hollow interior to hold oilfield material. The silo frame may be connected to at least one of the plurality of sidewalls of the silo. The silo frame may have a plurality of second retaining structures, and the first and second retaining structures may be joined together to secure the silo frame to the erecting mast for over-the-road transport.

An example implementation introduced in the present disclosure includes an MSS that supports at least one modular silo having at least two connectors. The modular support structure may have a support base, a frame structure connected to the support base, a first extendable base, and a first set of silo connectors on the first extendable base. The support base may have a first end, a second end, a top surface, a bottom surface, a first side, and a second side. The frame structure may extend above the support base to define a passage between the support base and the frame structure. The frame structure may have at least one silo-receiving region sized to receive at least one modular silo proximate the first side of the support base. The first set of silo connectors may have non-pivotable connections sized and dimensioned to mate with the connectors of the at least one modular silo to the first extendable base.

An example implementation introduced in the present disclosure includes an MSS for supporting at least one modular silo transported to the MSS on a chassis. The modular silo and the chassis may have a predetermined configuration. The MSS may have a support base, a frame structure extending above the support base, and a plurality of trailer alignment posts extending substantially vertically upward from the support base. The support base may have a first end, a second end, a top surface, a bottom surface, a first side, and a second side. The frame structure may define a passage between the top surface of the support base and the frame structure. The frame structure may have at least one silo-receiving region sized to receive at least one silo. The plurality of trailer alignment posts may be proximate the at least one silo receiving region. Each of the plurality of trailer alignment posts may be positioned relative to the frame structure based on the predetermined configuration of the modular silo and the chassis to align with the frame structure.

An example implementation introduced in the present disclosure includes a mobile erector assembly for erecting at least one silo. The mobile erector assembly may have a chassis, an erecting mast, and a positioning assembly. The chassis may have a first end, a second end, and a support beam extending between the first end and the second end. The erecting mast may have a lift structure with a first end, a second end, a first side, and a second side. The lift structure may be movably coupled to the chassis, proximate the second end of the chassis, to move from a transportation orientation to a mounting orientation. The lift structure may be sized and dimensioned to support a silo in the transportation orientation. The positioning assembly may be connected to the lift structure, and may have at least one rail connected to the lift structure, at least one engagement structure connected to the at least one rail, and at least one actuator connected to the lift structure and the at least one engagement structure. The rail may extend between the first and second ends of the lift structure. The at least one engagement structure may be movable on the rail between a first position and a second position. The at least one engagement structure may engage at least a portion of a silo, and may support the silo when the lift structure is in the mounting orientation. The at least one actuator may move the at least one engagement structure in relation to the lift structure between the first position and the second position with a sufficient amount of force to lift the silo when the lift structure is in the mounting orientation.

An example implementation introduced in the present disclosure includes a mobile erector assembly having a chassis, a cradle structure, an erecting mast, a first actuator, and a positioning assembly. The chassis may have a first end, a second end, and at least one support beam extending between the first end and the second end. The cradle structure may be supported by the support beam of the chassis, and may define an erecting mast void. The cradle structure may have a top surface for supporting at least one silo in a transportation orientation. The erecting mast may have a lift structure connected to at least one of the cradle structure and a portion of the chassis. The lift structure may move vertically beyond the top surface of the cradle structure from the transportation orientation to a mounting orientation. In the transportation orientation, the lift structure may be positioned within the erecting mast void. The first actuator assembly may engage the lift structure and at least one of the support beam, the chassis, and the cradle structure. The actuator may move the lift structure from the transportation orientation to the mounting orientation. The positioning assembly may be connected to the lift structure, and may have at least one rail, at least one engagement structure, and at least one second actuator assembly. The at least one rail may be connected to and extend along at least a portion of the lift structure. The at least one engagement structure may be connected to the at least one rail, and may be movable on the rail between a first position and a second position. The at least one second actuator assembly may be connected to the lift structure and the at least one engagement structure. The at least one engagement structure may engage at least a portion of a silo, and may support the silo when the lift structure is in the mounting orientation. The at least one actuator may move the at least one engagement structure from the first position to the second position with a sufficient amount of force to lift the silo when the lift structure is in the mounting orientation.

An example implementation introduced in the present disclosure includes a modular silo comprising a silo frame, an outer housing, and at least one lift structure. The silo frame may have a first end, a second end, and a side between the first end and the second end. The silo frame may be sized for over-the-road transport in a transportation orientation. The silo frame may have a plurality of first struts connected together to define a material space proximate the first end of the silo frame, and a plurality of second struts connected together to form a silo support structure proximate the second end of the silo frame. At least some of the second struts may be connected to corresponding ones of the first struts. The first struts may extend along the side of the silo frame. The outer housing may have an enclosed interior overlapping the material space. The at least one lift structure may be connected to at least one of the first struts within the set of first struts. The at least one lift structure may have a strength sufficient to lift the silo frame and the housing when the silo frame is in a mounting orientation.

An example implementation introduced in the present disclosure includes a method comprising positioning a silo in a transportation orientation on a chassis connected to an erecting mast operable to move the silo vertically from the transportation orientation to a mounting orientation. A positioning assembly may be connected to the erecting mast, and may have at least one engagement structure engaging and securing the silo to the erecting mast. The method may further comprise backing the chassis toward an MSS until a portion of the silo and a portion of the MSS overlap. The erecting mast and the silo may be moved from the transportation orientation to the mounting orientation, and the at least one engagement structure may be moved to place the silo onto the MSS.

FIG. 1 is a perspective view of an example implementation of a proppant delivery system 10 for forming a slurry suitable for fracturing formations according to one or more aspects of the present disclosure. The proppant delivery system 10 may comprise various equipment, including vehicles, storage containers, material handling equipment, pumps, control systems, and other equipment operable to facilitate the fracturing process, including as described below and depicted in the accompanying figures. However, the implementation depicted in FIG. 1 and the remaining figures is an example, and many other implementations also fall within the scope of the present disclosure.

The proppant delivery system 10 is illustrated in position at a wellsite 12 having a well 14 with at least one wellbore 16 extending into a subterranean reservoir/formation (not shown). The proppant delivery system 10 may comprise an MSS 18 for supporting one or more modular silos 20, such as may be transported over-the-road by trucks able to operate on public roadways. The modular silos 20 may be transported and mounted onto the MSS 18 by mobile erector assemblies, which will be described in more detail below. The modular silos 20 may be utilized at the wellsite 12 to store oilfield material such as a proppant, guar (utilized to increase the viscosity of a hydraulic fracturing fluid), and/or other suitable oilfield materials.

The modular silos 20 may receive oilfield material via one or more conveyors. For example, a trailer 22 may be positioned (e.g., backed by a tractor 23) over a first conveyor 24, such as may be a substantially horizontal belt or other conveyor positioned along the ground or otherwise operable to receive gravity-fed oilfield material from a chute or other outlet 26 of the trailer 22. The first conveyor 24 may transport the oilfield material to a second conveyor 28, such as may transport the oilfield material to an intermediate hopper 30. A third conveyor 32 may then transport the oilfield material into the top of a corresponding modular silo 20. The third conveyor 32 may be integral to the corresponding modular silo 20, and is thus partially obscured from view in the example implementation depicted in FIG. 1.

The proppant delivery system 10 may include other conveyors, in addition to or instead of those depicted in FIG. 1. One or more of the conveyors may operate by carrying the oilfield material, instead of blowing the oilfield material, such as may aid in avoiding dust generation and/or erosion of associated components. One or more of the conveyors may also be at least partially enclosed, such as may also aid in reducing dust generation as the oilfield material is delivered from the trailers 22 and into the modular silos 20.

The conveyor 24 may have a height (relative to the ground) of less than about twelve inches (or about 0.3 meters) or otherwise sufficient to permit the trailer 22 to be positioned over at least a portion of the conveyor 24. The length (along the ground) of the conveyor 24 may range between about eight feet (or about 2.4 meters) and about fifty feet (or about 15.2 meters). However, other dimensions are also within the scope of the present disclosure. The conveyors 24, 28, 32, and/or others may also be transported by truck.

The proppant delivery system 10 may also comprise various other components, such as water tanks (not shown) for supplying water that is mixed with the oilfield material to form the hydraulic fracturing fluid (e.g., proppant slurry) that may then be pumped downhole into the wellbore 16 via operation of a pumping system (not shown). The tanks and/or pumping system may also be truck-mounted, skid-mounted, or otherwise transportable over-the-road. The pumping system may comprise one or more pumps, such as may be coupled to a common manifold (not shown) operable to deliver the hydraulic fracturing fluid to the wellbore 16.

The proppant delivery system 10 may also comprise a blending system 34 operable to blend oilfield material delivered from the modular silos 20 with water and/or other materials. The blending system 34 may be or comprise a portable blender, such as a truck-mounted or skid-mounted blender. In the example implementation depicted in FIG. 1, the blending system 34 is mounted on a truck chassis 36, such as may be implemented as a trailer that may be positioned (e.g., backed up) in a common area 38 that is positioned underneath or proximate the modular silos 20. The proppant delivery system 10 may also comprise a control facility 40 and/or other components operable to facilitate a given fracturing operation. The common area 38 may be located at least partially below the modular silos 20, and may be at least partially formed by the MSS 18. In such implementations, the modular silos 20 may be supported over at least a portion of the common area 38 by the MSS 18.

Figure 2:
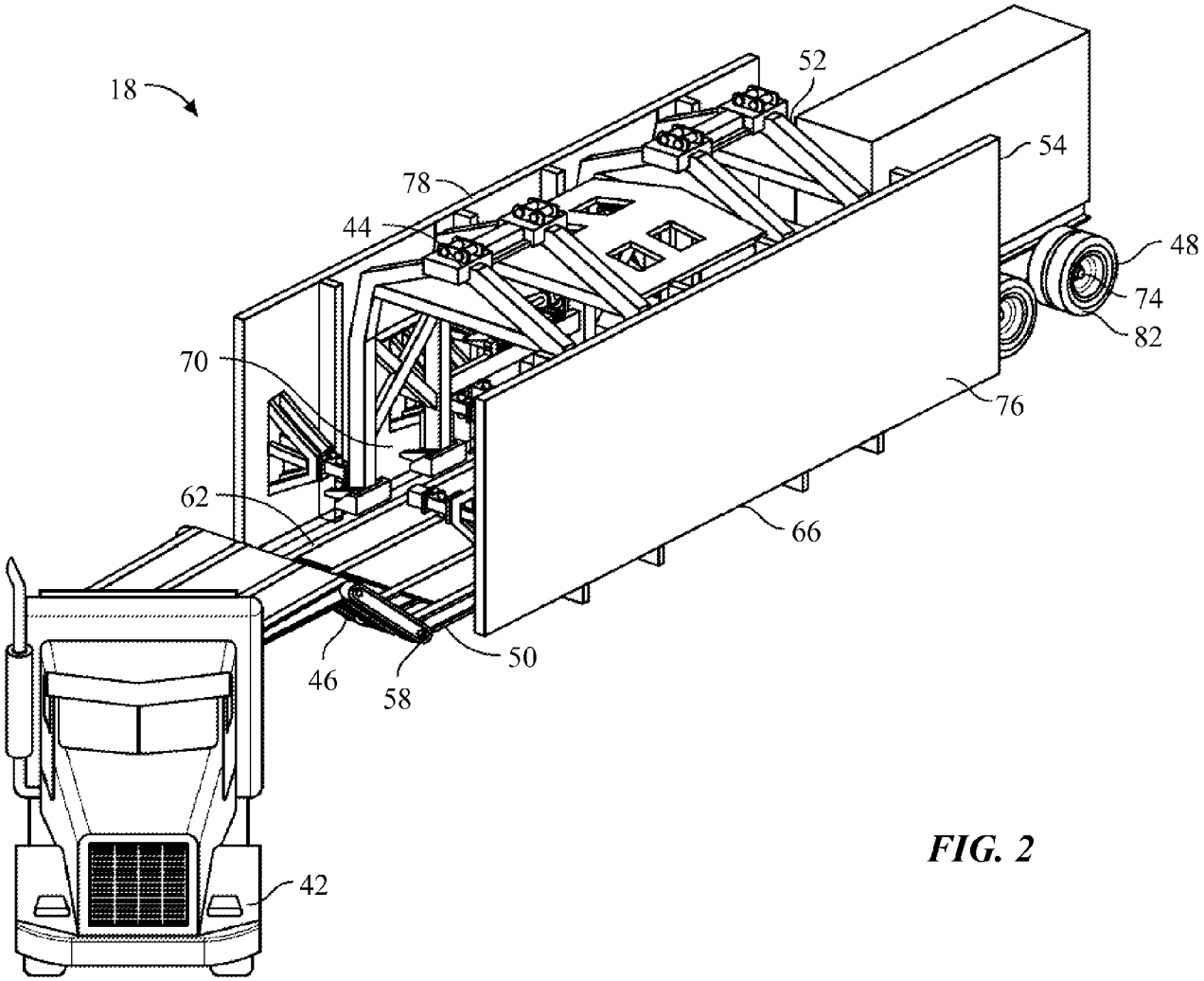
FIG. 2 is a perspective view of a portion of the apparatus shown in FIG. 1.
Figure 3:
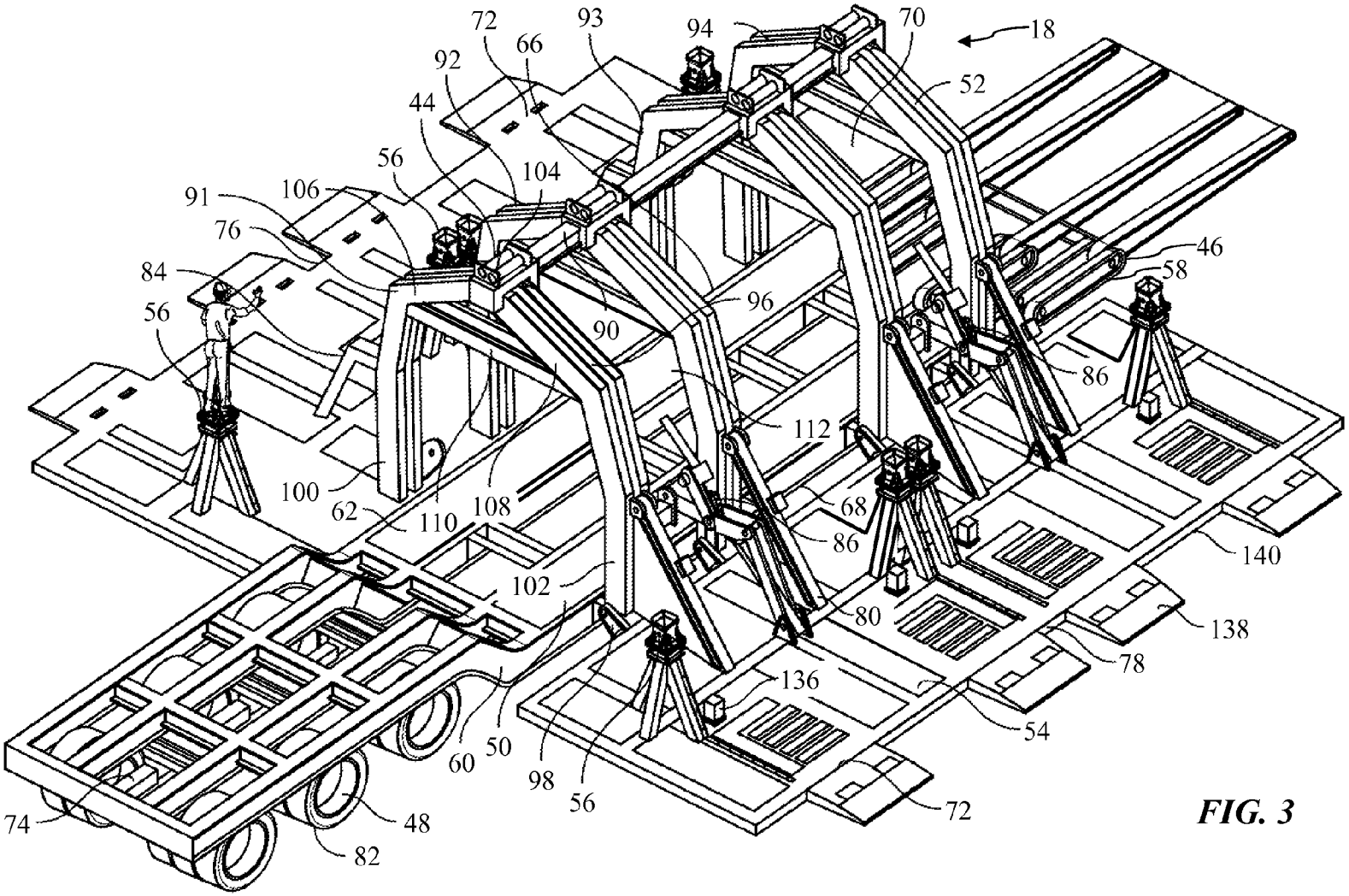
FIG. 3 is a perspective view of the apparatus shown in FIG. 2 in another stage of operation.
Figure 4:
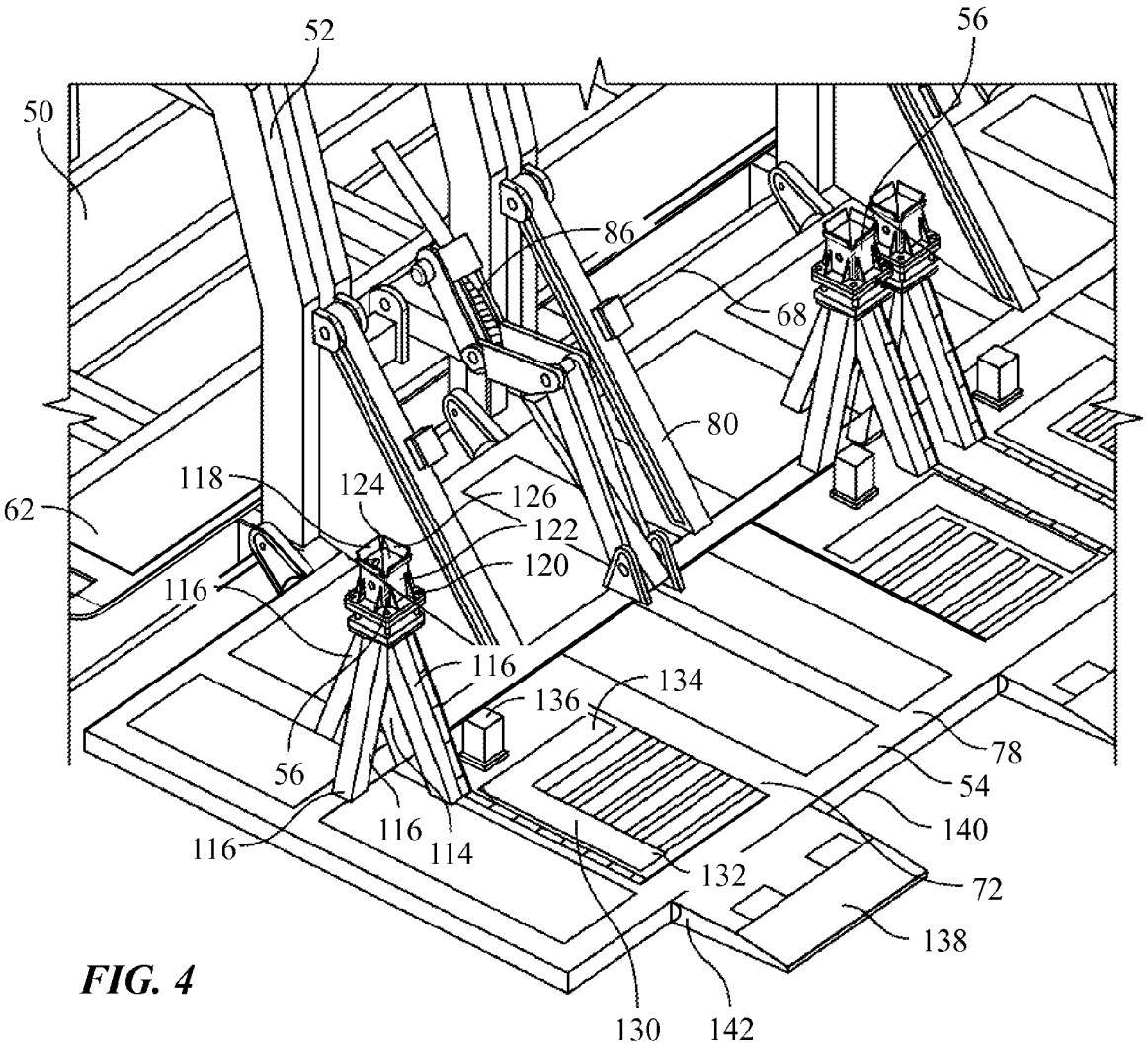
FIG. 4 is a perspective view of a portion of the apparatus shown in FIG. 3.

FIG. 2 is a perspective view of the MSS 18 shown in FIG. 1, but in a transportation configuration by which the MSS 18 may be transported on roadways, such as via a truck 42. FIG. 3 is a different perspective view of the MSS 18 shown in FIGS. 1 and 2 after conversion into the operational configuration for supporting the modular silos 20, and after being detached from the truck 42. FIG. 4 is an enlarged perspective view of the MSS 18 in the configuration shown in FIG. 3. The following description applies to FIGS. 1-4, collectively, where applicable.

In general, the MSS 18 may comply with various state, federal, and international regulations for transport over roadways and highways. In this regard, the MSS 18 may have a width equal to or less than about 12 feet (or about 3.7 meters), a height equal to or less than about 13.5 feet (or about 4.1 meters), and a length equal to or less than about 53 feet (or about 16.2 meters).

The MSS 18 comprises one or more connectors 44 each operable to engage a portion of a corresponding modular silo 20 to be mounted to the MSS 18. The MSS 18 is depicted as being able to support up to four modular silos 20. However, the MSS 18 may support another number of modular silos 20.

The MSS 18 may include a gooseneck portion 46 and a plurality of wheels 48. The gooseneck portion 46 may be attached to the truck 42 such that the truck 42 may move the MSS 18 between various locations, such as between the wellsite 12 and another wellsite. The MSS 18 may thus be transported to the wellsite 12 and then set up to support one or more modular silos 20.

The MSS 18 comprises a support base 50, a frame structure 52 connected to the support base 50, an extendable base 54, and a number of silo connectors 56 disposed on the extendable base 54. The support base 50 may include a first end 58, a second end 60, a top surface 62, a first side 66, and a second side 68. The frame structure 52 extends above the support base 50 to define a passage 70 generally located between the top surface 62 of the support base 50 and the frame structure 52. The frame structure 52 includes one or more silo-receiving regions 72 each configured to receive a modular silo 20. For example, the frame structure 52 may define four silo-receiving regions 72 each configured to support a corresponding one of the modular silos 20.

The gooseneck portion 46 may extend from the first end 58 of the support base 50. Axles 74 for the plurality of wheels 48 may be located proximate the second end 60 of the support base 50, as shown in FIG. 3, proximate the first end 58 of the support base 50, and/or at various locations relative to the support base 50 to support the components of the MSS 18.

The extendable base 54 may include a first extendable base 76 on the first side 66 of the support base 50, and a second extendable base 78 on the second side 68 of the support base 50. In such implementations, the first and second extendable bases 76 and 78 may aid in laterally supporting the modular silos 20 and the frame structure 52, such as may aid in preventing the modular silos 20 and the frame structure 52 from falling over. The first and second extendable bases 76 and 78 may also serve as a loading base for a truck during mounting of the modular silos 20 onto the MSS 18, as explained below.

The first and second extendable bases 76 and 78 may be movably connected to at least one of the frame structure 52 and the support base 50 via one or more mechanical linkages 80 such that the first and second extendable bases 76 and 78 may be selectively positioned between the transportation configuration, as shown in FIG. 2, and the support configuration, as shown in FIG. 3. In the transportation configuration, the first and second extendable bases 76 and 78 may extend substantially vertically and adjacent to at least a portion of the frame structure 52, such as to be within acceptable size limits for transporting the MSS 18 on public roads and highways. However, in the support configuration, the first and second extendable bases 76 and 78 may extend substantially horizontally from the frame structure 52, such as may aid in laterally supporting the modular silos 20 and/or to provide a loading base for trucks mounting the modular silos 20 to the MSS 18.

In the transportation configuration, the support base 50 may be located above a lower portion (e.g., a lower half) 82 of the wheels 48. In the support configuration, at least a portion of the support base 50 may be positioned on the ground, and at least a portion of the support base 50 may be substantially aligned with the lower portion 82 of the wheels 48. When at least a portion of the support base 50 is positioned on the ground and the first and second extendable bases 76 and 78 are positioned in the support configuration, the support base 50 and the first and second extendable bases 76 and 78 may be substantially coplanar. The support base 50 and the first and second extendable bases 76 and 78 may also be positioned on a pad (not shown), such as may aid in stabilizing the support base 50 and the extendable bases 76 and 78 on the ground at the wellsite 12 prior to erecting the modular silos 20 onto the MSS 18.

The one or more mechanical linkages 80 movably connecting the frame structure 52 and/or the support base 50 with the first and second extendable bases 76 and 78 may include a first set of hinges connecting the first extendable base 76 to the frame structure 52 and/or the support base 50, and a second set of hinges connecting the second extendable base 78 to the frame structure 52 and/or the support base 50. To automate the movement of the first and second extendable bases 76 and 78 between the support configuration and the transportation configuration, the one or more mechanical linkages 80 may include a first set of actuators 84 and a second set of actuators 86, respectively. The first set of actuators 84 may be connected to the frame structure 52 and/or the support base 50 and the first extendable base 76. The second set of actuators 86 may be connected to the frame structure 52 and/or the support base 50 and the second extendable base 78. The first and second sets of actuators 84 and 86 may be operable to selectively move the first and second extendable bases 76 and 78, respectively, between the support configuration and the transportation configuration. Each set of actuators 84 and 86 may be constructed in a variety of manners, such as may comprise a hydraulic cylinder, a pneumatic cylinder, a solenoid, and/or a manual activation mechanism. The first and second sets of actuators 84 and 86 may each comprise two actuators, as shown in FIG. 3, although other numbers of actuators may also be provided depending, for example, on the size of the actuators and the first and second extendable bases 76 and 78.

The frame structure 52 may comprise multiple frames 91-94 interconnected by multiple struts 90. The frames 91-94 may be substantially parallel to each other, and may be substantially similar in construction and function. Each frame 91-94 may comprise a top member 96, a bottom member 98, and two side members 100 and 102, such as may be connected to form a closed structure surrounding at least a portion of the passage 70. Two or more of the members 96, 98, 100, and 102 within each frame 91-94 may be integrally formed. The side members 100 and 102 and the top member 96 may form an arch, such as may increase the structural strength of each frame 91-94. The top member 96 may include an apex 104 that may be centrally located between the side members 100 and 102. The connectors 44 may be connected to each frame 91-94 at the apex 104 such that each connector 44 may connect to at least a portion of the corresponding modular silo 20 at the top of each frame 91-94. The top member 96 may include a first leg 106 and a second leg 108, which may be connected together at the apex 104. The first leg 106 may be connected to the side member 100, and the second leg 108 may be connected to the side member 102. The top member 96 may also comprise or be connected to a support beam 110. The support beam 110 may reinforce the first leg 106 and the second leg 108, such as may aid in preventing relative deflection of the first and second legs 106 and 108 when the modular silos 20 are being supported. Each frame 91-94 may be formed from suitable materials able to support the load from the modular silos 20. For example, the frames 91-94 may be constructed form tubular steel, I-beams, channel, and/or other suitable material, and may be connected together via various mechanical fastening techniques, such as may utilize one or more bolts, plates, welds, and/or other connection means.

One of the struts 90 may connect the frames 91 and 92 in a manner permitting jointly supporting two modular silos 20 in the corresponding silo-receiving regions 72. Likewise, another strut 90 may connect the frames 93 and 94 in a manner permitting jointly supporting two additional modular silos 20 in the corresponding silo-receiving regions 72. The connectors 44 may also be disposed within corresponding silo-receiving regions 72. For example, two connectors 44 may be provided at the apex 104 of each of the frames 91-94, where each connector 44 may attach to a corresponding modular silo 20.

The extendable base 54, such as the first and second extendable bases 76 and 78, may comprise the silo connectors 56. For example, one or more pairs of silo connectors 56, with each pair corresponding to one of the modular silos 20, may be positioned on the corresponding first or second extendable base 76, 78 proximate the corresponding silo-receiving region 72. The silo connectors 56 may each comprise non-pivotable connections operable to mate each modular silo 20 to the corresponding extendable base 76, 78. As shown in FIGS. 3 and 4, the silo connectors 56 may be coupled to the first or second extendable base 76, 78, and may be positioned at a lower elevation than the connectors 44 located on the apex 104 of the frames 91-94, in a manner permitting the connectors 44 and the silo connectors 56 to cooperatively engage each modular silo 20 as each modular silo 20 is mounted on the MSS 18.

When the first and second extendable bases 76 and 78 are extended into the support configuration, as shown in FIGS. 3 and 4, the silo connectors 56 may extend vertically upward from the first and second extendable bases 76 and 78. Each silo connector 56 may comprise a post 114 and one or more struts 116 coupled to the corresponding extendable base 76, 78, such that each silo connector 56 may support at least a portion of the weight of the modular silo 20 when mounted onto the MSS 18. The post 114 and struts 116 may be formed from steel pipe, I-beams, channel, and/or other suitable materials, and may be connected together via various suitable connection methods, such as mechanical fastening via bolt and nut connectors, welding, plates, other suitable mechanical fastening techniques, and combinations thereof.

As shown in FIG. 4, each silo connector 56 may comprise a top end 118, a bottom end 120, and sidewalls 122 each extending at least partially between the top and bottom ends 118 and 120. The sidewalls 122 may at least partially surround a receiving space or passageway 124 for receiving a lower end of the corresponding modular silo 20. Each silo connector 56 may also have a flared portion 126 at the top end 118, such as may accommodate insertion of the lower end of the modular silo 20 while the modular silo 20 is being mounted to the MSS 18.

The first and second extendable bases 76 and 78 may also comprise one or more chassis guides 130. Each chassis guide 130 may be positioned on one of the first and second extendable bases 76 and 78, and may be spaced apart by a predetermined distance. For example, in implementations in which a truck with a trailer is transporting the modular silo 20, the truck may be provided with first and second wheels having outer sidewalls spaced apart by a wheel clearance, and the space between each pair of chassis guides 130 may correspond (e.g., be slightly larger than) the wheel clearance. The chassis guides 130 may be coupled to or formed integral with the first and second extendable bases 76 and 78 in positions corresponding to the wheel clearance, perhaps spaced apart at a distance of about 5% to about 20% more than the wheel clearance. Each chassis guide 130 may comprise a first portion 132 and a second portion 134 disposed at an angle with respect to the first portion 132. For example, the first and second portions 132 and 134 of the chassis guides 130 may be implemented as raised portions of the first and second extendable bases 76 and 78, or as portions of pipe, channel, or other suitable materials connected to the first and second extendable bases 76 and 78 via various suitable connection mechanisms, such as welding, plates, and/or nut and bolt connectors.

The MSS 18 may also comprise a number of chassis alignment posts 136 extending vertically upward from the first and second extendable bases 76 and 78. For example, two chassis alignment posts 136 may be positioned proximate each silo-receiving region 72. Each chassis alignment post 136 may be positioned relative to the frame structure 52 based on a predetermined configuration of the modular silo 20 and a chassis used to transport and mount the modular silo 20, such that the chassis alignment posts 136 may at least partially align the chassis with the frame structure 52. For example, a pair of chassis alignment posts 136 may be positioned a predetermined distance apart within each silo-receiving region 72, where such distance may be based on the width of the chassis transporting the modular silo 20 and/or dimensions of the first and second extendable bases 76 and 78. Each chassis alignment post 136 may be implemented as steel tubing, pipe, channel, blocks, or other suitable materials that may be connected to the first and second extendable bases 76 and 78 and that have sufficient strength to engage and withstand alignment of at least a portion of the chassis.

The first and second extendable bases 76 and 78 may also comprise one or more extendable ramps 138 at outer ends 140 thereof. The extendable ramps 138 may be connected to the first and second extendable bases 76 and 78 via one or more pivot joints 142 and/or other manner permitting the extendable ramps 138 be collapsed into a compact position when the MSS 18 is in the transportation configuration, and subsequently pivoted into the depicted extended position when the MSS 18 is in the support configuration. In the extended position, the extendable ramps 138 may also aid in aligning the chassis transporting the modular silos 20 and positioning a portion of the chassis over the extendable bases 76 and 78.

Figure 5:
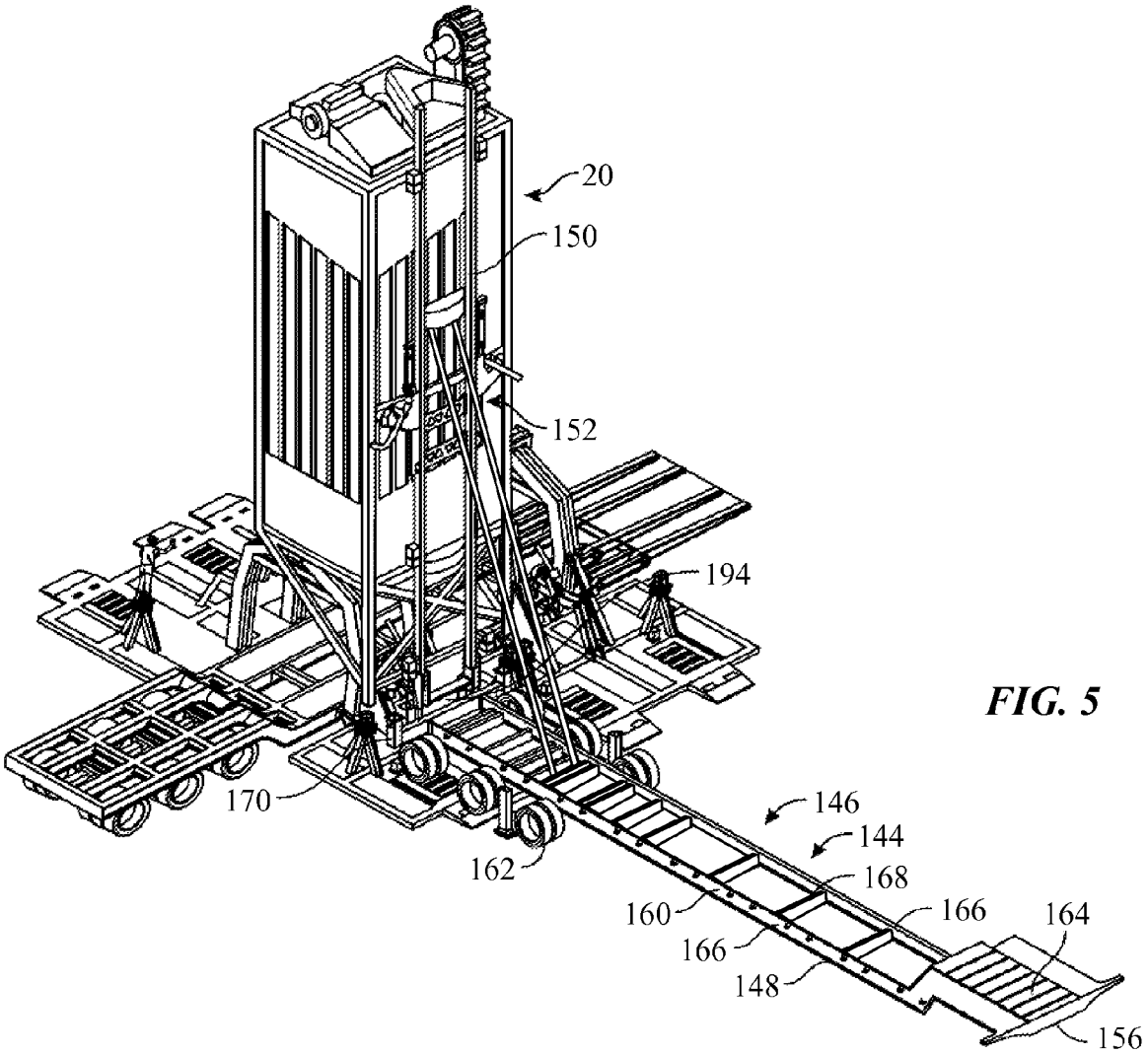
FIG. 5 is a perspective view of a portion of the apparatus shown in FIG. 1.
Figure 6:
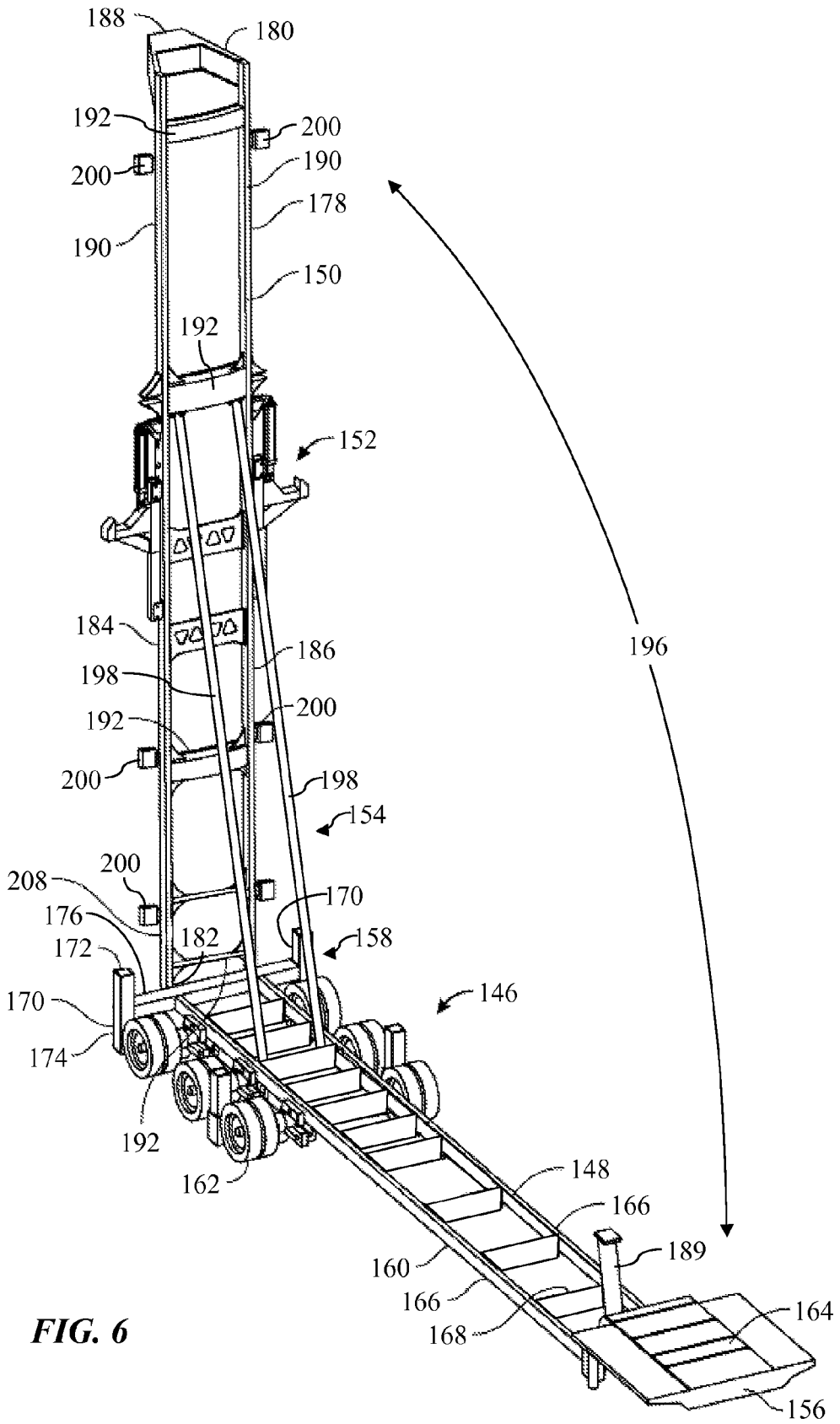
FIG. 6 is a perspective view of the apparatus shown in FIG. 5 in another stage of operation.
Figure 7:
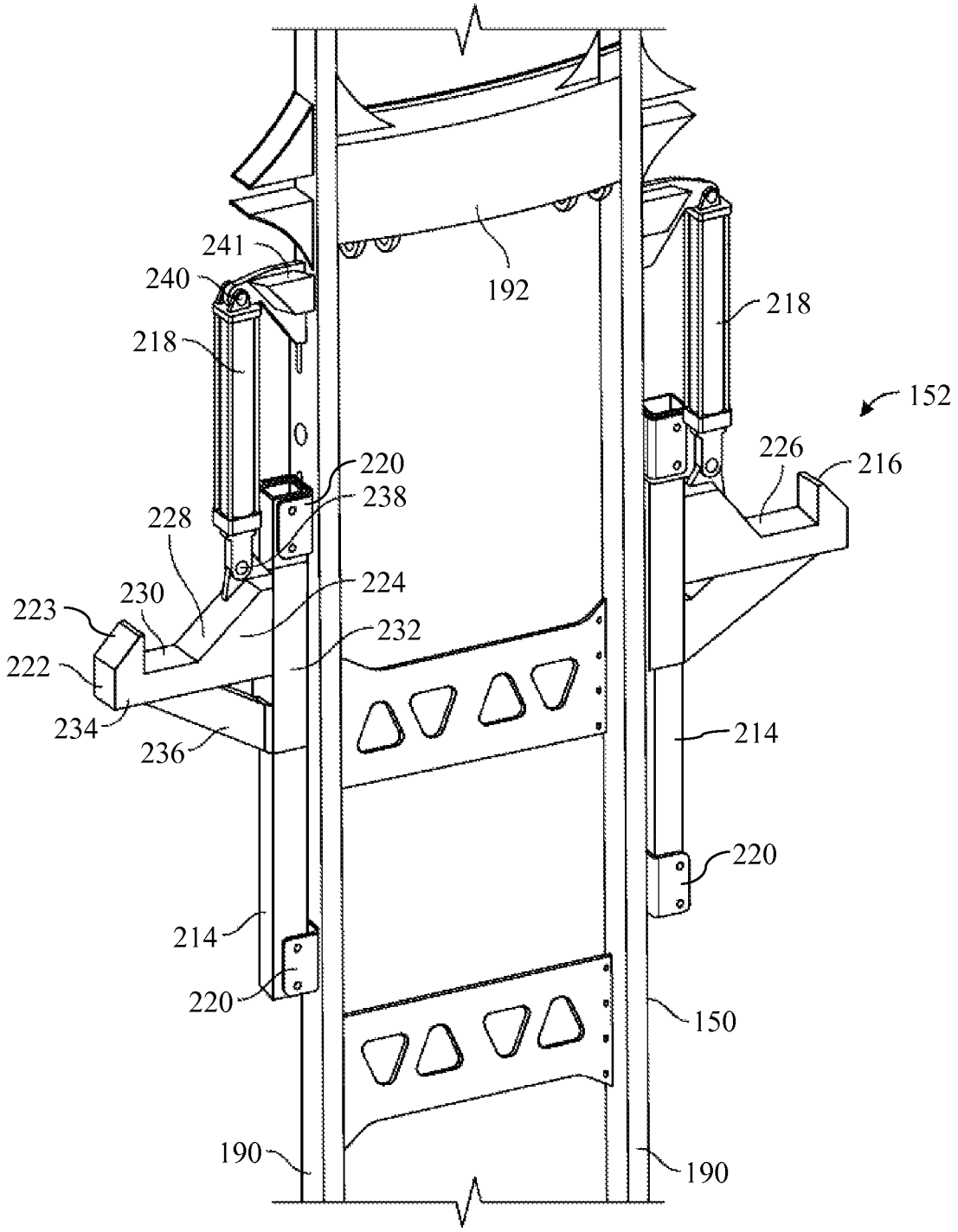
FIG. 7 is a perspective view of a portion of the apparatus shown in FIG. 6.
Figure 8:
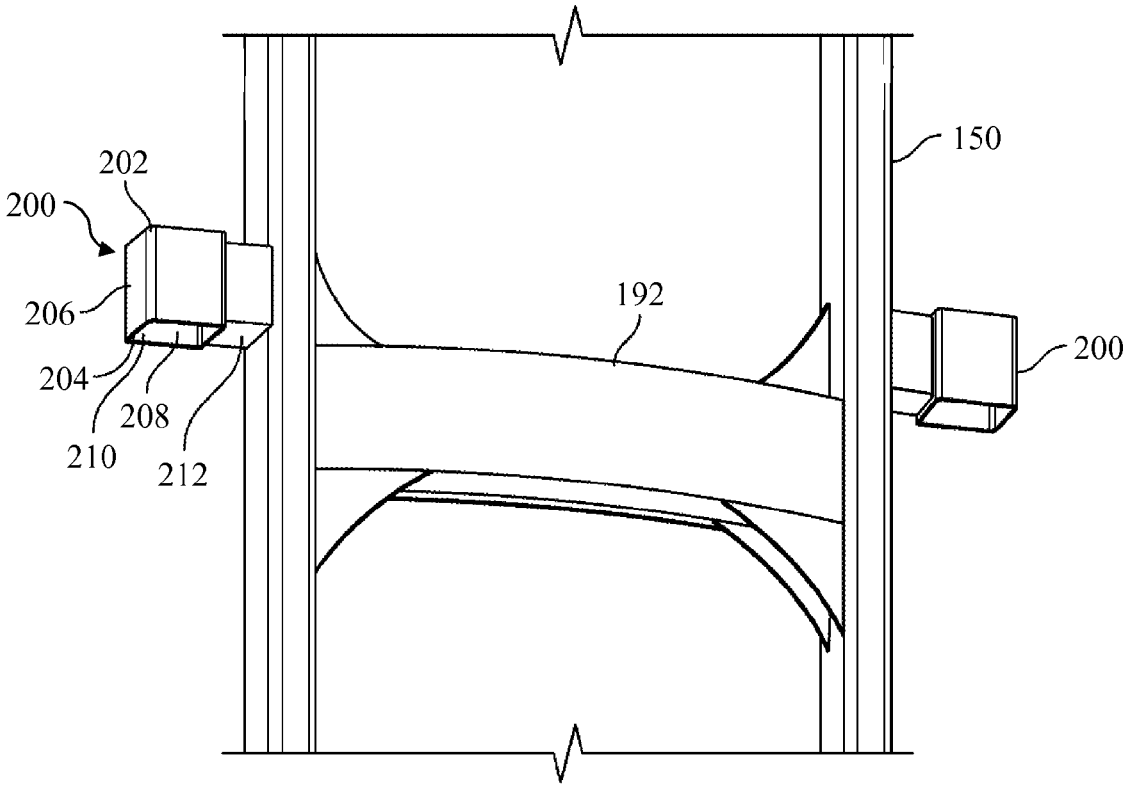
FIG. 8 is a perspective view of a portion of the apparatus shown in FIG. 6.

FIG. 5 is a perspective view of a portion of the MSS 18 shown in FIG. 1 and an oilfield material container transport assembly 144 according to one or more aspects of the present disclosure. FIG. 6 is a perspective view of the oilfield material container transport assembly 144 shown in FIG. 5 in another stage of operation. FIGS. 7 and 8 are perspective views of different portions of the oilfield material container transport assembly 144 as shown in FIG. 6 (although the actuator assembly 154 described below has been removed from FIGS. 7 and 8 for the purpose of clarity). The following description refers to FIGS. 5-8, collectively, perhaps with continuing reference to FIGS. 1-4, where applicable and indicated by like reference numerals.

The oilfield material container transport assembly 144 may comprise a mobile erector assembly 146 operable for erecting a modular silo 20. The oilfield material container transport assembly 144 may comply with various state, federal, and international regulations for transport over roadways and highways. In this regard, the oilfield material container transport assembly 144 may have a width of less than about 9.5 feet (or about 2.6 meters), a height of less than about fourteen feet (or about 4.3 meters), and a length of less than about 53 feet (or about 16.2 meters).

The mobile erector assembly 146 may comprise a chassis 148, an erecting mast 150, a positioning assembly 152, and an actuator assembly 154. The chassis 148 may support the modular silo 20 and be operable for being pulled by a truck, such as the truck 23 shown in FIG. 1 and/or the truck 42 shown in FIG. 2, to transport the modular silo 20 to the wellsite 12.

The chassis 148 comprises a first end 156 (e.g., a front end), a second end 158 (e.g., a rear end), and a support beam 160 extending between the first end 156 and the second end 158. In implementations in which the chassis 148 is to be pulled by a truck, the chassis 148 may also comprise a plurality of wheels 162 located at least partially underneath and operably connected to the support beam 160 and/or another portion of the chassis 148. The wheels 162 may be located at least partially underneath a horizontal plane intersecting and parallel to the support beam 160. In implementations in which the chassis 148 is implemented as a trailer, the chassis 148 may further comprise a trailer hitch 164 located proximate the first end 156. The trailer hitch 164 may be a gooseneck hitch and/or other types of hitches. However, it should be understood that the chassis 148 may also or instead be implemented as a sled, skid, and/or other transportation means.

The support beam 160 may be formed from two or more support beams 166 connected together to by support members 168 to collectively form a substantially horizontal structural support. The support members 168 may be spaced a distance apart from one another between the first and second ends 156 and 158 of the chassis 148. The components of the support beam 160 may be formed from steel beam, channel, plate, and/or other materials having sufficient strength and durability to transport the modular silo 20 as described herein.

The chassis 148 may comprise at least one alignment member 170 connected to the support beam 160 and extending generally downward from the second end 158 of the chassis 148. For example, the chassis 148 may comprise two alignment members 170 on opposing sides of the second end 158 of the chassis 148. Each alignment member 170 may comprise an upper portion 172 and a lower portion 174. The upper portion 172 may be connected to the support beam 160 by a connection beam 176, for example, and the lower portion 174 may telescope or otherwise extend down from the upper portion 172 for engagement with a corresponding chassis alignment post 136 of the MSS 18 (see FIG. 3). Engaging the chassis alignment post 136 with the lower portion 174 of the alignment member 170 may aid in aligning at least a portion of the chassis 148 with the MSS 18. The upper and lower portions 172 and 174 of the alignment member 170 and the connection beam 176 may be formed from steel beam, channel, plate, and/or other materials, and may be connected to each other and the support beam 160 by nut and bolt connectors, plates, welding, and/or other suitable connection mechanisms.

The erecting mast 150 is connected to the chassis 148 in a manner permitting movement of the erecting mast 150 relative to the chassis 148. The erecting mast 150 comprises a lift structure 178 with a first end 180, a second end 182, a first side 184, and a second side 186. The second end 182 of the lift structure 178 may be movably coupled to the chassis 148 proximate the second end 158 of the chassis 148. The lift structure 178 is operable to move from a substantially horizontal transportation orientation to a substantially vertical mounting orientation. Thus, the lift structure 178 supports the modular silo 20 in the transportation orientation for transporting the modular silo 20 to the wellsite 12, and lifts the modular silo 20 during assembly of the modular silo 20 onto the MSS 18.

The lift structure 178 may comprise a first end member 188 forming or otherwise proximate the first end 180, two or more support beams 190 extending between the first and second ends 180 and 182, and a number of lateral support members 192 extending between the support beams 190 at various intervals between the first and second ends 180 and 182. The first end member 188 may be supported (at least vertically) by a support post 189 extending upward from the chassis 148. The components of the lift structure 178 may be formed from steel beam, channel, plate, and/or other materials, and may be connected to each other by nut and bolt connectors, plates, welding, and/or other suitable connection mechanisms. However, it will be understood that the lift structure 178 may have other configurations and still permit the lift structure 178 to support at least a portion of the modular silo 20 when moving from the transportation orientation to the mounting orientation.

Figure 15:
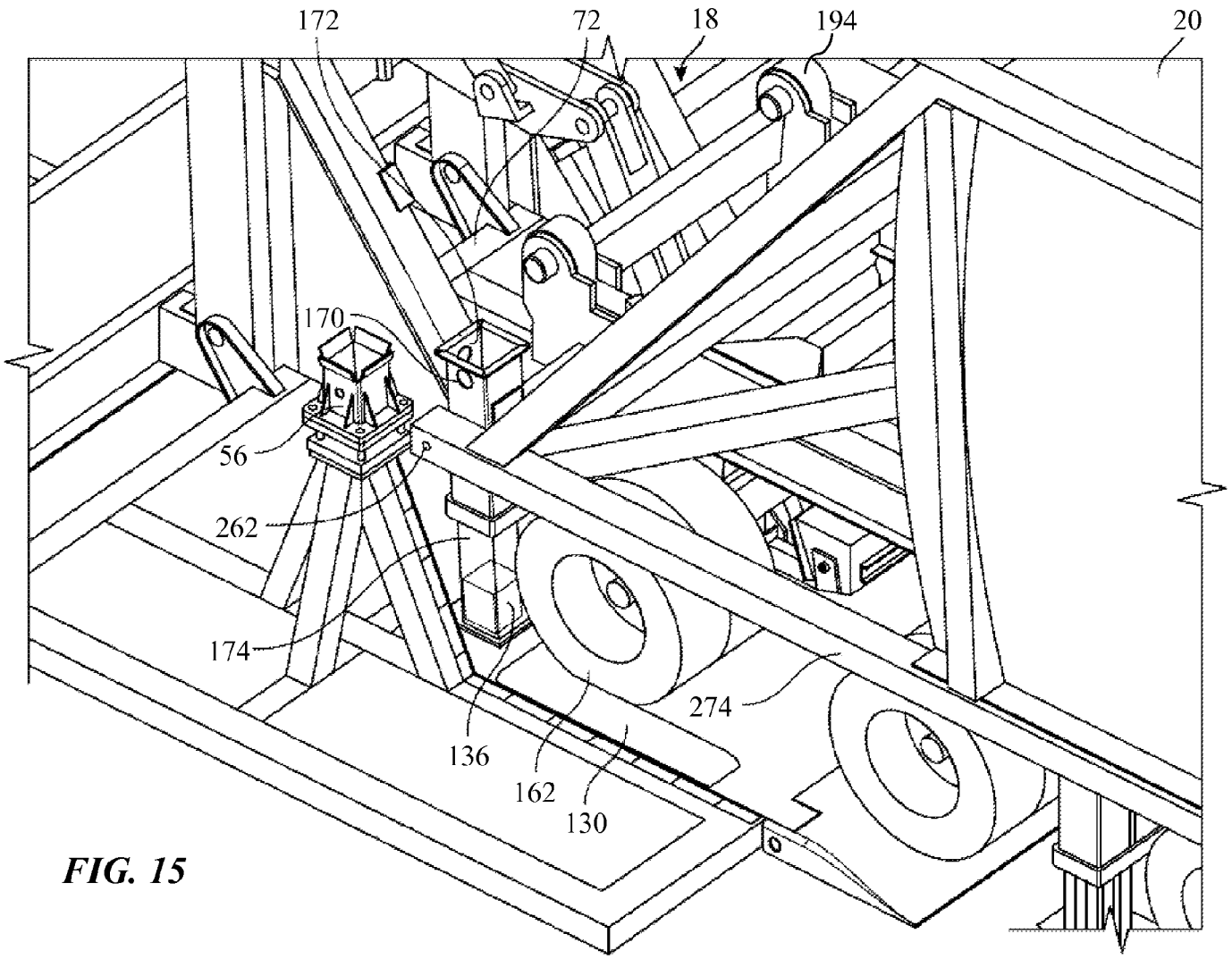
FIG. 15 is a perspective view of a portion of the apparatus shown in FIG. 14.

The support beams 190 or other portion of the lift structure 178 at or near the second end 182 may be connected to (or near) the second end 158 of the chassis 148 via a pivot connection 194 (see FIG. 15). The actuator assembly 154 may extend between the lift structure 178 of the erecting mast 150 and the support beam 160 of the chassis 148, such that extension and retraction of the actuator assembly 154 moves the lift structure 178 in a substantially arc-shaped path 196 between the transportation (e.g., substantially horizontal) orientation and the mounting (e.g., substantially vertical) orientation. As depicted in FIGS. 5 and 6, the actuator assembly 154 may comprise multiple actuators 198 operable to cooperatively move the lift structure 178 between the transportation and mounting orientations. The actuator assembly 154 may comprise one or more hydraulic actuators, pneumatic actuators, electrical actuators, mechanical actuators, and/or other suitable mechanisms capable of moving the lift structure 178 and an accompanying modular silo 20 from the transportation orientation to the mounting orientation.

The erecting mast 150 may also comprise a number of first retaining structures 200 each configured to mate with a corresponding second retaining structure (described below) to prevent movement of the modular silo 20 relative to the erecting mast 150. As shown in FIG. 8, each first retaining structure 200 may have a first end 202, a second end 204, and sidewalls 206 extending between the first and second ends 202 and 204. The sidewalls 206 may define and extend at least partially around a receiving space 208 with an entrance 210 facing the second end 158 of the chassis 148 and configured to receive and engage at least a portion of the corresponding second retaining structure of the modular silo 20. Such engagement may aid in positionally fixing the modular silo 20 relative to the erecting mast 150. The first retaining structures 200 may be formed from steel beam, channel, plate, and/or other materials, and may be connected to the erecting mast 150 by nut and bolt connectors, plates, welding, and/or other suitable connection mechanisms. Each first retaining structure 200 may also be or comprise a clamp, a claw-like connection, a pin or loop for a pin-and-loop connection, or other suitable connections.

The first retaining structures 200 may each be connected to the erecting mast 150 directly or via an offset structure 212. The offset structures 212 may each aid in positioning the first retaining structures 200 away from the erecting mast 150, whether in or offset from a common plane of the erecting mast 150.

The positioning assembly 152 may comprise at least one rail 214 connected to the lift structure 178, at least one engagement structure 216, and at least one actuator 218. The engagement structure 216 is connected to and moveable on the at least one rail 214 between a first position shown in FIG. 7 and a second position shown in FIG. 19. The actuator 218 is operable to move the engagement structure 216 relative to the lift structure 178 between the first and second positions.

Each rail 214 may be connected to and substantially parallel with a corresponding support beam 190, and may have a smooth outer surface or may be toothed. Brackets 220 may connect each rail 214 to the corresponding support beam 190, perhaps in a manner permitting the rail 214 to be spaced outward from yet perhaps substantially coplanar with the lift structure 178, such as may permit each engagement structure 216 to at least partially encircle at least a section of the corresponding rail 214. For example, the portion of each engagement structure 216 that encircles the corresponding rail 214 may travel (substantially vertically in the orientation depicted in FIG. 7) along the rail 214 between the first and second positions. In some implementations, one or more engagement structures 216 may comprise gearing (not shown) that engages with a toothed portion (not shown) of the corresponding rail 214, such as may form a rack and pinion arrangement.

Each engagement structure 216 may engage a portion of the modular silo 20 for supporting the modular silo 20 when the lift structure 178 is in (or moving to/from) the mounting orientation. As depicted in the example implementation shown in the figures, each engagement structure 216 may comprise an outer end 222, an inner end 224, and a surface 226 extending at least partially between the outer and inner ends 222 and 224. The outer end 222 includes an upwardly (in the orientation shown in FIG. 7) extending projection 223 that may aid in detachably engaging a corresponding portion of the modular silo 20, as described below. The surface 226 may include a first portion 228 and a second portion 230. The first portion 228 may be angled with respect to the second portion 230, such as to provide greater strength and rigidity for connection with the moving end of the corresponding actuator 218. The first portion 228 may also aid in aligning the modular silo 20 when supported by the lift structure 178.

Each engagement structure 216 may be formed from solid and/or tubular steel, such as may be machined or cast into the example form depicted in FIG. 7. Each engagement structure 216 may also or instead comprise a number of struts. For example, each engagement structure 216 may comprise a first strut 232 extending along and at least partially encircling a corresponding rail 214, a second strut 234 extending outward substantially perpendicularly from the first strut 232, and a third strut 236 extending at an angle between the first and second struts 232 and 234, such as may aid in bracing the first strut 232 while the engagement structure 216 is supporting at least a portion of the weight of the modular silo 20 in the mounting orientation. The struts 232, 234, 236 may be formed from steel tubing, pipe, channel, or other suitable materials.

Each actuator 218 may move the corresponding engagement structure 216 between the first and second positions with a sufficient amount of force to also move the modular silo 20 when the lift structure 178 is substantially vertical, including when the modular silo 20 is substantially full of oilfield material. A first end 238 of each actuator 218 may be connected to the corresponding engagement structure 216, and a second end 240 of each actuator 218 may be connected to the lift structure 178, perhaps via one or more bracket members 241. Each actuator 218 may be or comprise a hydraulic cylinder, a pneumatic cylinder, a solenoid, or other suitable actuator operable with sufficient force to lift at least a portion of the modular silo 20 when the lift structure 178 is substantially vertical.

Figure 9:
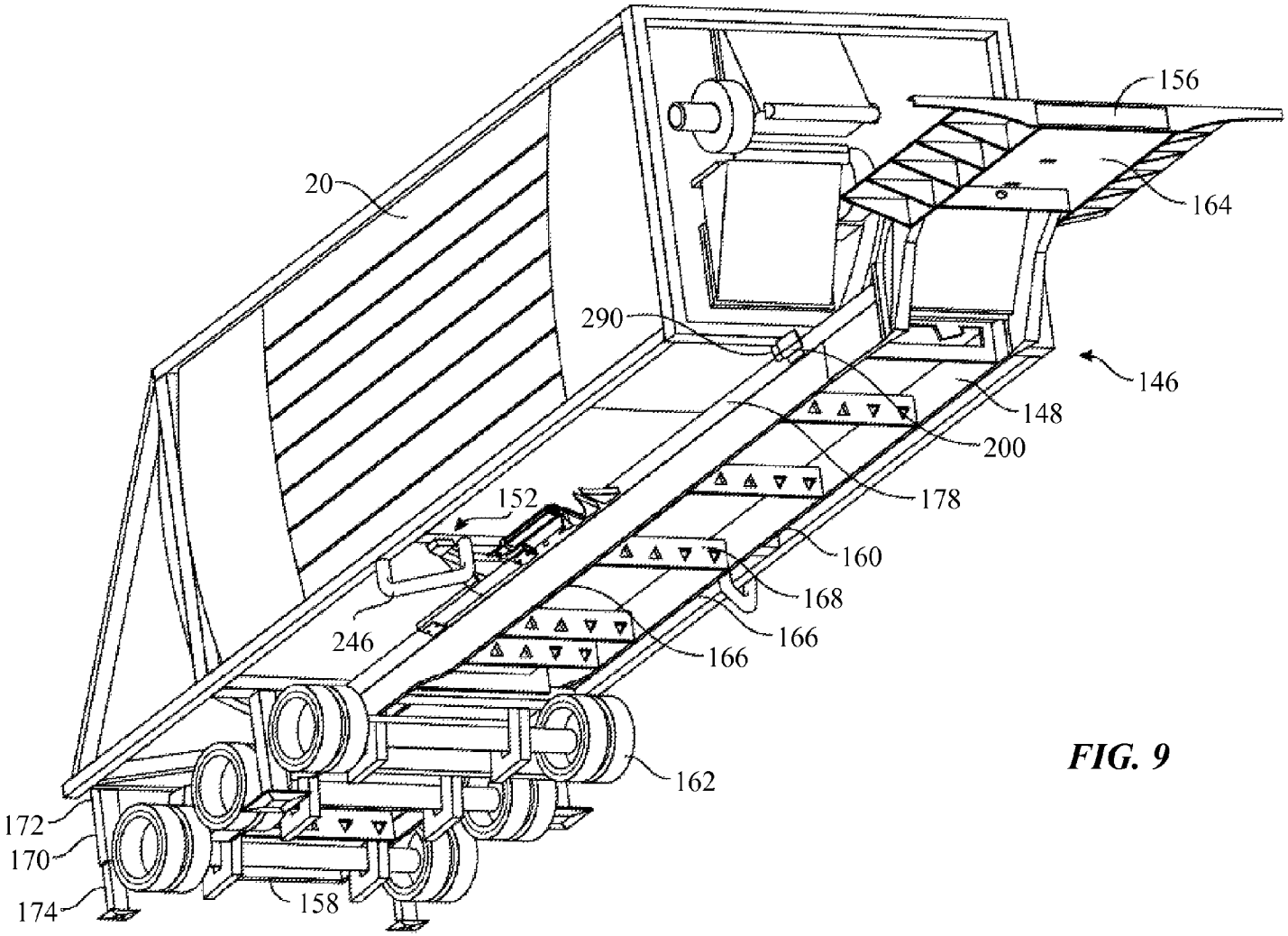
FIG. 9 is a perspective view of the apparatus shown in FIG. 5 in another stage of operation.
Figure 10:
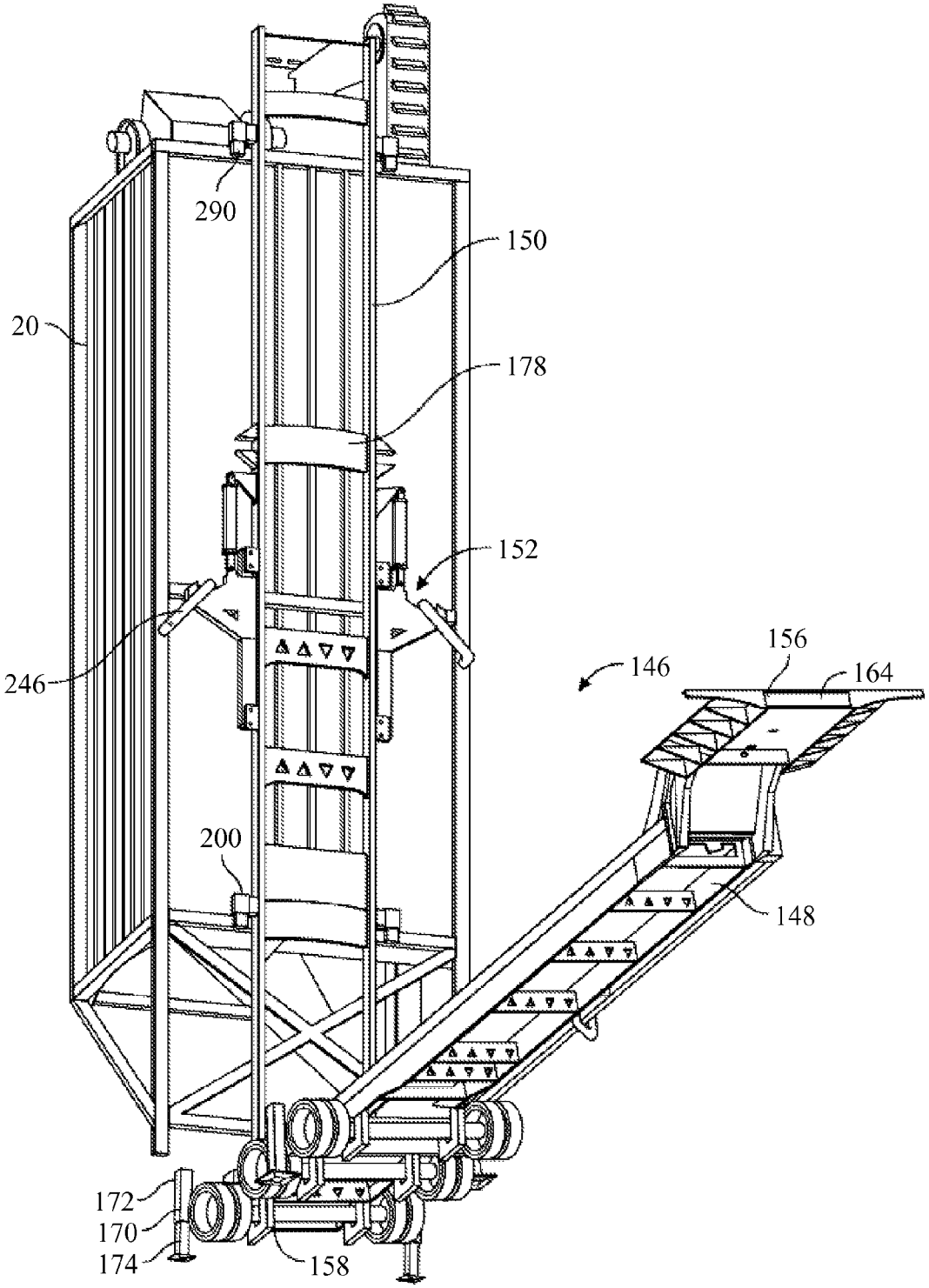
FIG. 10 is a perspective view of the apparatus shown in FIG. 9 in another stage of operation.
Figure 11:
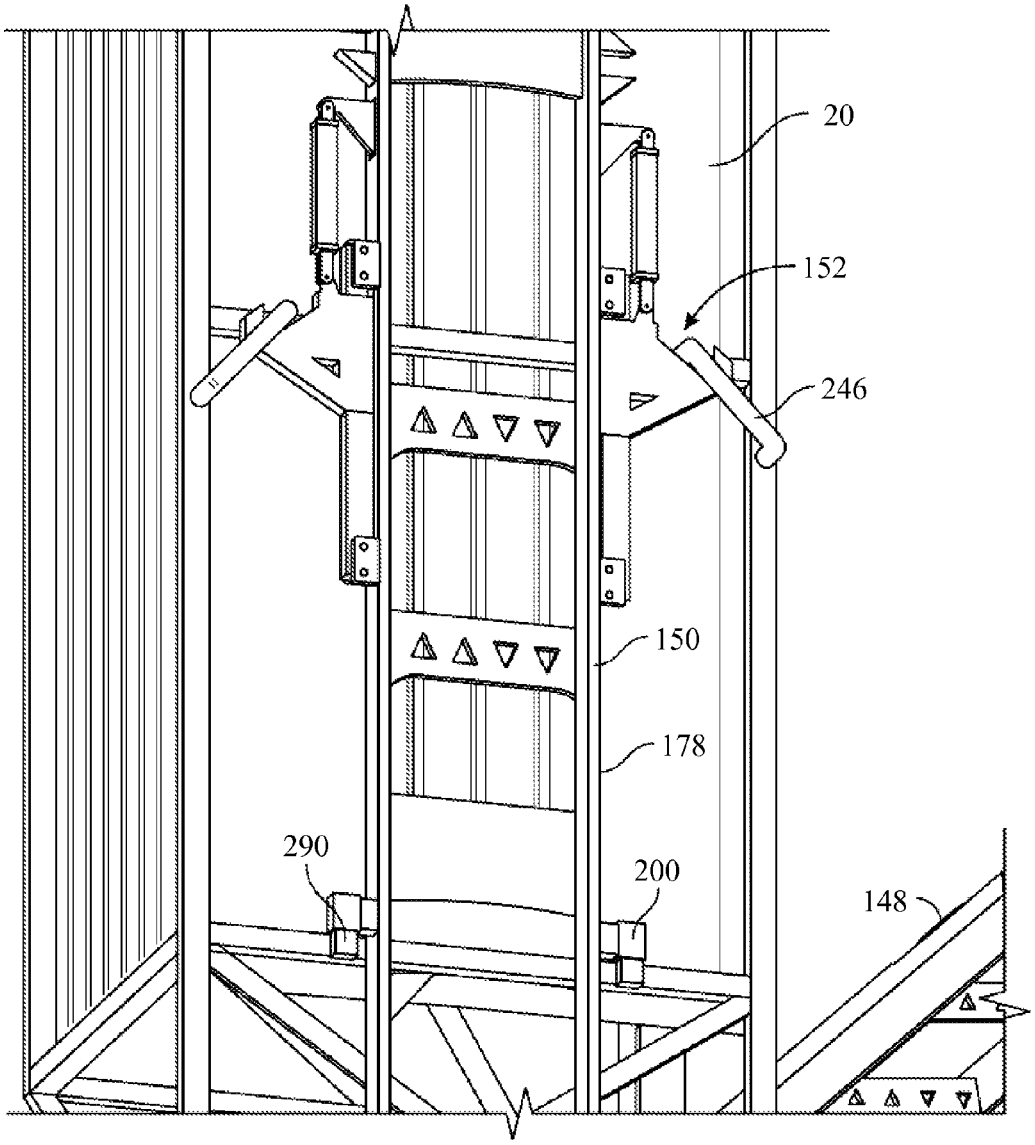
FIG. 11 is a perspective view of a portion of the apparatus shown in FIG. 10.
Figure 12:
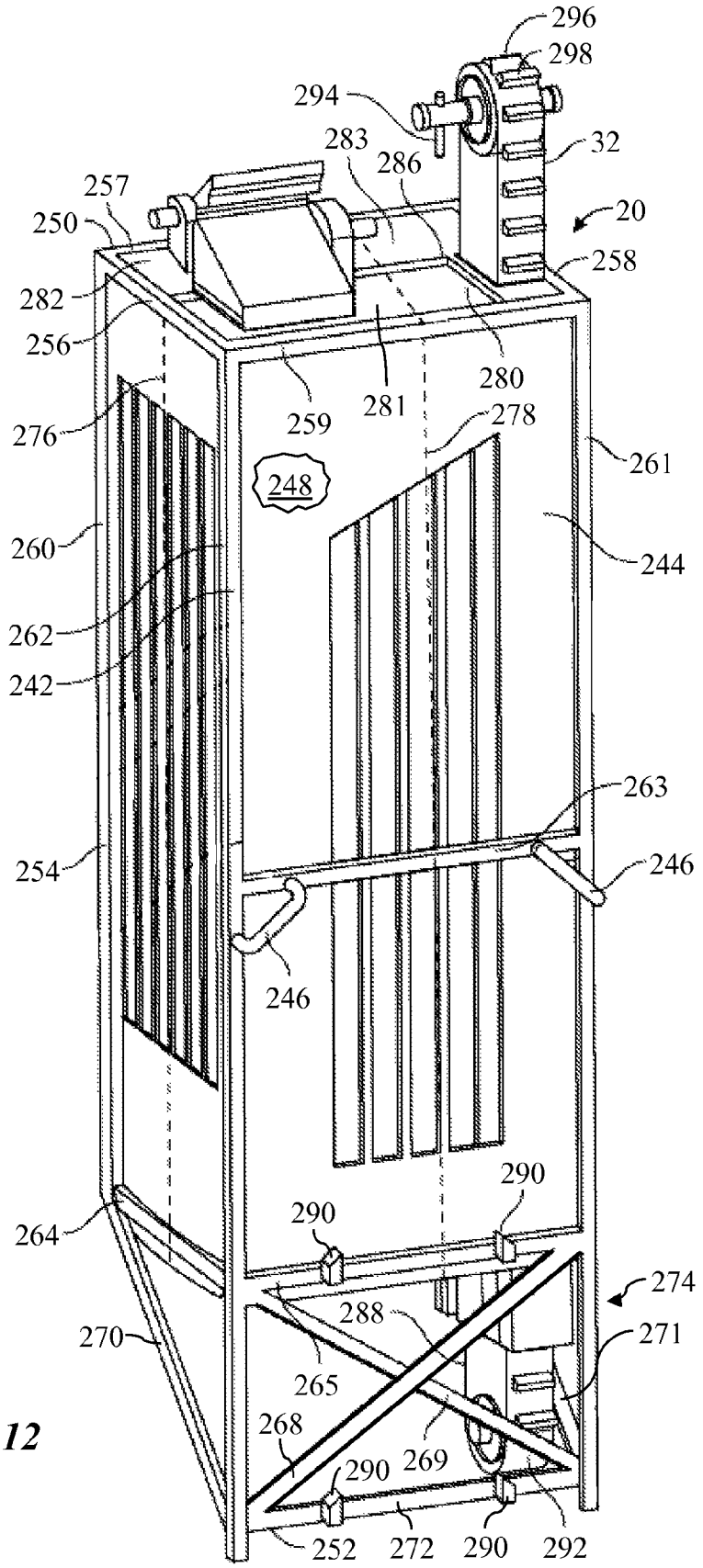
FIG. 12 is a perspective view of the apparatus shown in FIG. 11 in another stage of operation.
Figure 13:
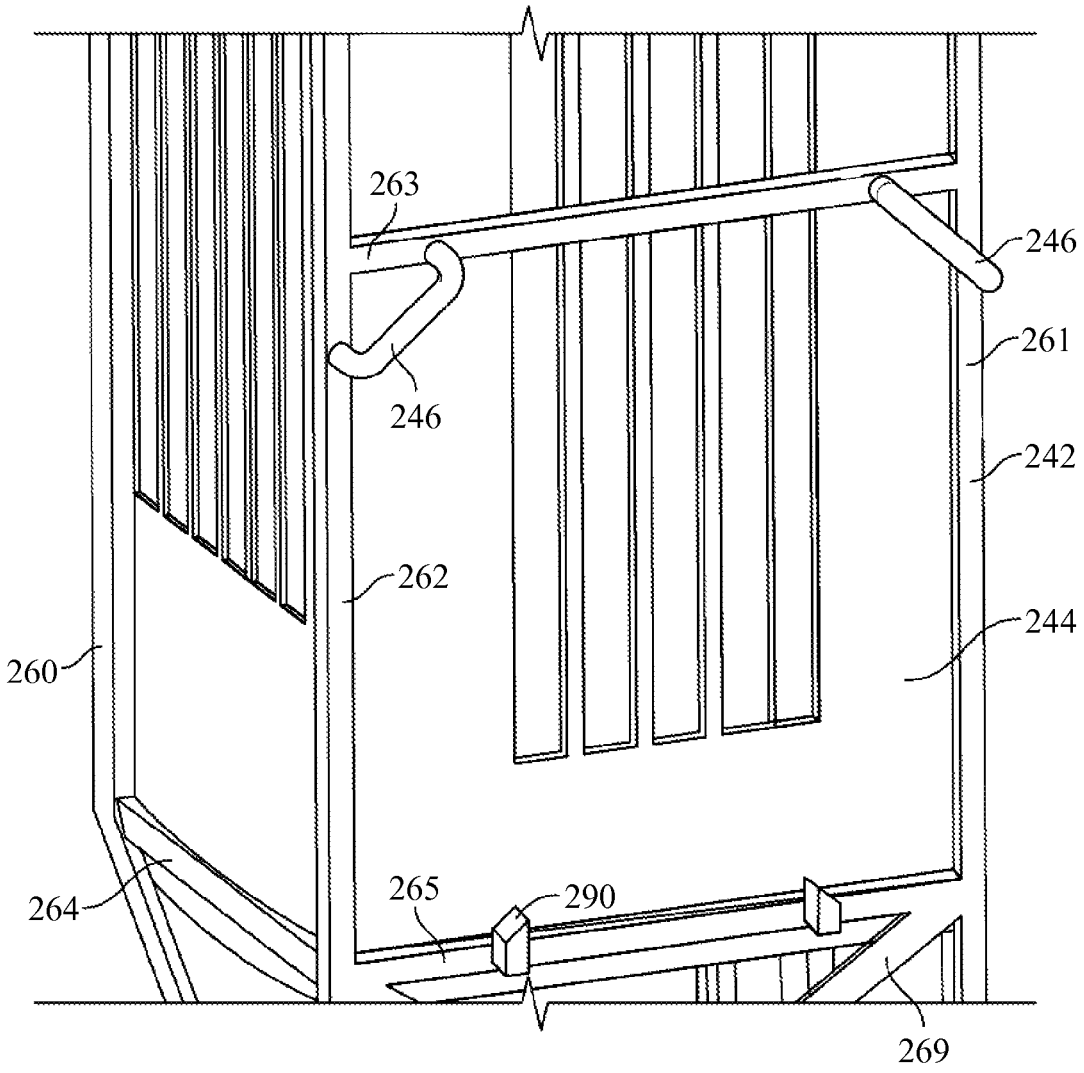
FIG. 13 is a perspective view of a portion of the apparatus shown in FIG. 12.

FIG. 9 is a perspective view of the mobile erector assembly 146 and the modular silo 20 in the transportation orientation. FIG. 10 is a perspective view of the mobile erector assembly 146 and the modular silo 20 in the mounting orientation. FIG. 11 is a perspective view of an enlarged portion of the mobile erector assembly 146 and the modular silo 20 as shown in FIG. 10. FIG. 12 is a perspective view of an example implementation of the modular silo 20. FIG. 13 is a perspective view of an enlarged portion of the modular silo 20 shown in FIG. 12. The following description refers to FIGS. 9-13, collectively, perhaps with continuing reference to FIGS. 1-8, where applicable and indicated by like reference numerals.

In the transportation orientation shown in FIG. 9, the modular silo 20 may be supported in a substantially horizontal position on the lift structure 178. For example, as described below, structures on the mounting silo 20 may operate in conjunction with the positioning assembly 152 and the one or more first retaining structures 200 to secure and retain the mounting silo 20 to the mobile erector assembly 146 and the lift structure 178, such as may prevent the modular silo 20 from lateral movement with respect to the mobile erector assembly 146. In the mounting orientation shown in FIGS. 10 and 11, the modular silo 20 may be supported in a substantially vertical position by the mobile erector assembly 146 and the lift structure 178. For example, as described below, structures on the mounting silo 20 may operate in conjunction with the positioning assembly 152 to support the modular silo 20 and lower the modular silo 20 onto the MSS 18 to mount the modular silo 20 or to lift the modular silo 20 from the MSS 18.

The modular silo 20 may comprise a silo frame 242, an outer housing 244, and one or more lift features 246. The outer housing 244 may define an enclosed interior 248 for holding oilfield material. The silo frame 242 may support the outer housing 244. Each lift feature 246 may be connected to the silo frame 242.

The silo frame 242 may have a first end 250, a second end 252, and one or more sides 254 extending between the first and second ends 250 and 252. The silo frame 242 may be sized for over-the-road transport in the transportation orientation. The transportation orientation may be substantially horizontal, such that the sides 254 may be substantially parallel to at least a portion of the chassis 148. The silo frame 242 may comprise a number of struts 256-265 connected together to collectively define a material space between the first and second ends 250 and 252. The silo frame 242 may also comprise a number of struts 268-272 connected together to collectively form a silo support structure 274. The silo support structure 274 is proximate the second end 252 of the silo frame 242, substantially underneath the silo 20 in the mounting orientation. The struts 256-265 and 268-272 may be formed from steel tubing, beam, channel, plate, or other suitable materials, and may be connected by welds, bolt and nut fasteners, and/or other suitable types of fastening methods to support at least a portion of the outer housing 244 and the modular silo 20.

One or more of the struts 256-265 may collectively form at least a portion of the silo frame 242 as a cuboid or other shape surrounding the outer housing 244. For example, the silo frame 242 may include struts 260-262 (and another strut hidden from view in FIG. 12) extending along the sides 254 of the silo frame 242 between the first and second ends 250 and 252. The struts 261 and 262 may terminate at or below the second end 252 of the silo frame 242, and may engage with corresponding silo connectors 56 of the MSS 18. For example, when the positioning assembly 152 in the mounting orientation lowers the modular silo 20, the struts 261 and 262 may be inserted into the corresponding silo connectors 56. In implementations in which the silo connectors 56 include flared portions 128, the flared portions 128 may aid in guiding ends of the struts 261 and 262 into the silo connectors 56, thereby at least partially aligning at least a portion of the modular silo 20 while the modular silo 20 is being mounted onto the MSS 18.

The outer housing 244 may include an upper portion proximate the first end 250, and a lower portion proximate the second end 252. The outer housing 244 may also include a first center plane 276 extending between the sides 254 substantially parallel to the struts 260-262 and substantially bisecting the struts 256, 258, and 264, and a second center plane 278 substantially perpendicular to the first center plane 276 and substantially bisecting the struts 257, 259, and 265. The first and second center planes 276 and 278 may be considered to partition the modular silo 20, the silo frame 242, the outer housing 244, and/or the enclosed interior 248 into quadrants 280-283. The outer housing 244 may comprise an inlet 286 located at the upper portion of the outer housing 244 and a feeder 288 located at the lower portion. The inlet 286 and the feeder 288 may be encompassed within the quadrant 280. The outer housing 244 may also comprise an outlet (not shown) encompassed within the quadrant 280, with the feeder 288 connected to and in fluid communication with the outlet.

The lift features 246 may each be connected to corresponding ones of the struts (e.g., struts 261-263), and may extend towards the first and second ends 250 and 252 of the silo frame 242 at an angle ranging between about forty degrees and about sixty degrees. The lift features 246 may have strength sufficient to support lifting the silo frame 242 and the outer housing 244 when the silo frame 242 is in or moving to/from the mounting orientation. For example, the lift features 246 may be of sufficient strength to bear the weight of the modular silo 20 when the positioning assembly 152 engages the lift features 246 to lift the modular silo 20 in a substantially vertical direction with respect to the ground, including when the modular silo 20 is substantially full of oilfield material.

The modular silo 20 may also comprise second retaining structures 290. The second retaining structures 290 may be configured to mate with and/or engage with the first retaining structures 200 on the erecting mast 150, as described above, such that the second retaining structures 290 and the lift features 246 may cooperate with the first retaining structures 200 and the positioning assembly 152, respectively, to aid in preventing movement of the modular silo 20 relative to the mobile erector assembly 146 while in the transportation orientation. The second retaining structures 290 may be formed from steel tubing, plate, and/or other suitable materials, and may be connected to one or more struts (e.g., strut 265) of the silo frame 242 via welds, bolt and nut fasteners, and/or other suitable types of fastening techniques.

Depending on the wellsite operation, the oilfield material contained within each modular silo 20 may comprise naturally occurring sand grains or gravel, man-made proppants, resin coated sand, high-strength ceramic materials (e.g., sintered bauxite), other solids such as fibers, mica, mixtures of different sized oilfield materials, mixtures of different types of oilfield materials, and/or other suitable oilfield materials. One or more of the modular silos 20 may be internally divided into a plurality of compartments, such as may correspond to the quadrants 280-283, each holding different types of oilfield materials that may be selectively released from the modular silo 20 and blended via the blending system 34. The conveyor 32 that may be enclosed within each modular silo 20 may lift oilfield material (e.g., with or without blowing) from an inlet 292 (such as an inlet hopper), disposed at the lower portion of the modular silo 20, to the upper portion of the modular silo 20 for release into the enclosed interior 248, such as through a vertical conveyor head 294. The conveyor head 294 may have a pivotable or otherwise moveable discharge, such as may be selectively controllable to deliver the oilfield material to the corresponding compartment within the modular silo 20.

The vertical conveyor 32 may be positioned within the enclosed interior 248 in a manner that may aid in reducing the generation and/or escape of dust. For example, the vertical conveyor 32 may be mounted to the outer housing 244 and extend from the lower portion to the upper portion of the modular silo 20. The vertical conveyor 32 may be or comprise a bucket elevator 296 having a plurality of buckets 298 conveyed in a continuous loop to lift oilfield material from the inlet 292 to the conveyor head 294. However, the vertical conveyor 32 may also or instead be or comprise a screw auger, a pneumatic fill tube, and/or other material transfer means.

The outflow of oilfield material to the blending system 34 (e.g., through the feeder 288) may be controlled by a suitable outflow control mechanism (not shown). For example, the blending system 34 may include a hopper having an inlet positioned below the feeder 288. The inlet of the hopper may have a width of up to about twelve feet (or about 3.7 meters), such as a width ranging between about eight feet (or about 2.4 meters) and about 8.5 feet (or about 2.6 meters). The hopper may also have an outflow control mechanism that may be similar to the outflow control mechanism of the modular silo 20. The oilfield material may be gravity fed through the feeder 288, and the amount of outflow may be governed by the outflow control mechanism of the modular silo 20. The oilfield material may flow into a blender of the blending system 34, and may be regulated by the outflow control mechanism of the hopper and the outflow control mechanism of the modular silo 20.

Figure 14:
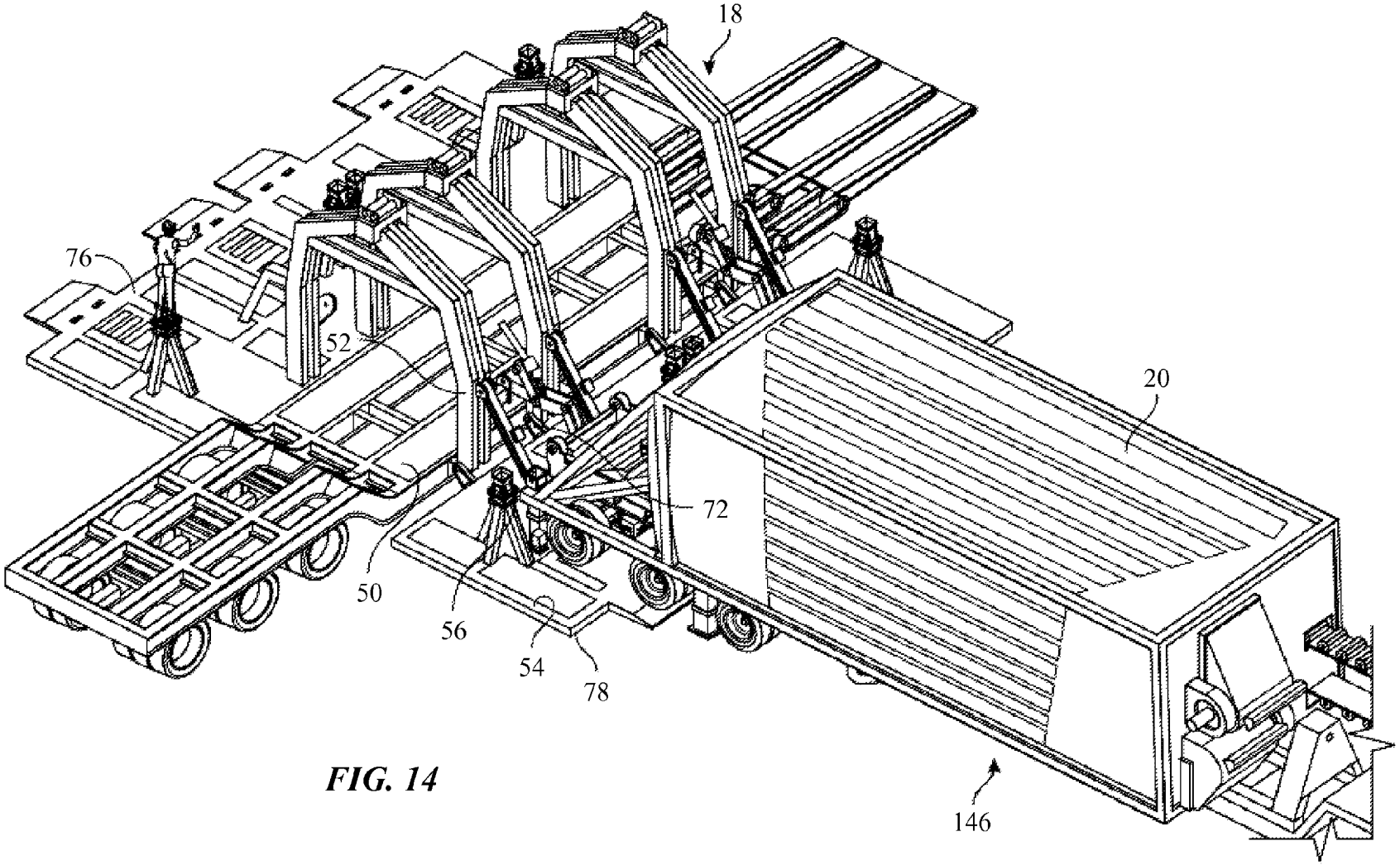
FIG. 14 is a perspective view of the apparatus shown in FIG. 5 in another stage of operation.

FIGS. 14-21 are perspective views of the apparatus described above during various stages of operation according to aspects of the present disclosure. For example, FIGS. 14 and 15 depict the modular silo 20 positioned in the transportation orientation on the chassis 148 of the mobile erector assembly 146. The modular silo 20 has been connected to the erecting mast 150, such as via engagement of the first retaining structures 200 of the mobile erector assembly 146 with the corresponding second retaining structures 290 of the modular silo 20, and/or via engagement of the engagement structures 216 with the lift features 246 of the modular silo 20. As more clearly shown in FIG. 15, the mobile erector assembly 146 may be moved (e.g., backed) toward the MSS 18 until a portion of the modular silo 20 and a portion of the MSS 18 overlap. For example, this may include aligning the wheels 162 of the chassis 148 with the chassis guides 130 disposed on the extendable base 76, 78 of the MSS 18. Adequate alignment of the chassis 148 with the MSS 18 may also or instead comprise positioning one or more of the alignment members 170 with the corresponding one or more chassis alignment posts 136 disposed on the extendable base 76, 78 of the MSS 18, such as by lowering the lower portions 174 of the alignment members 170 onto the chassis alignment posts 136.

Figure 16:
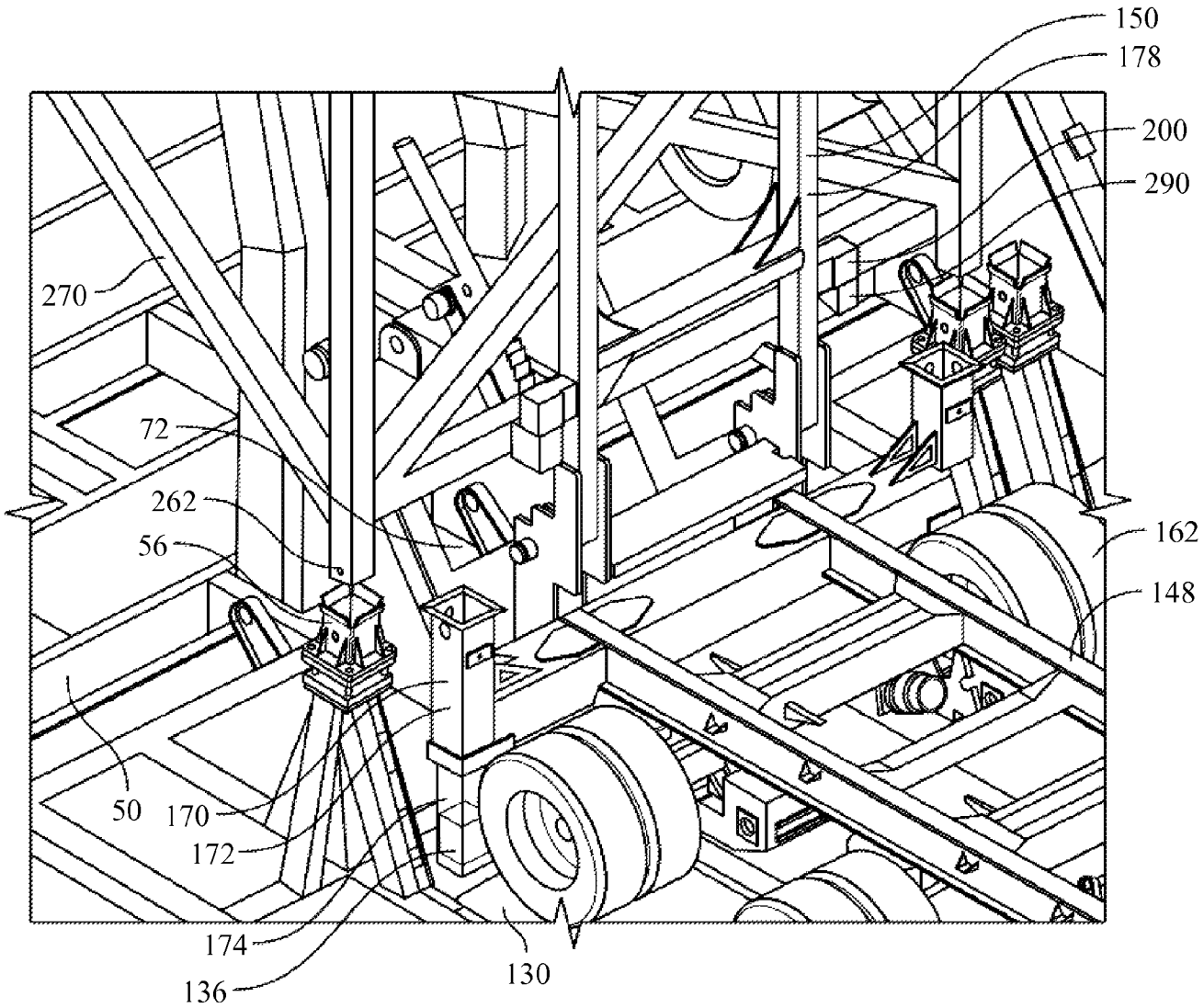
FIG. 16 is a perspective view of the apparatus shown in FIG. 15 in another stage of operation.

The erecting mast 150 and the modular silo 20 may then be moved from the transportation orientation to the mounting orientation, as shown in FIGS. 5, 10, and 16. For example, the actuator assembly 154 of the erecting mast 150 may be extended, thereby rotating the erecting mast 150 and the modular silo 20 upward and away from the chassis 148. The alignment of the chassis 148 relative to the MSS 18, and the subsequent erection of the erecting mast 150 and modular silo 20, may vertically align the lower ends of the silo frame 242 (e.g., the lower ends of the struts 261 and 262) over the corresponding silo connectors 56, as shown in FIG. 16.

Figure 17:
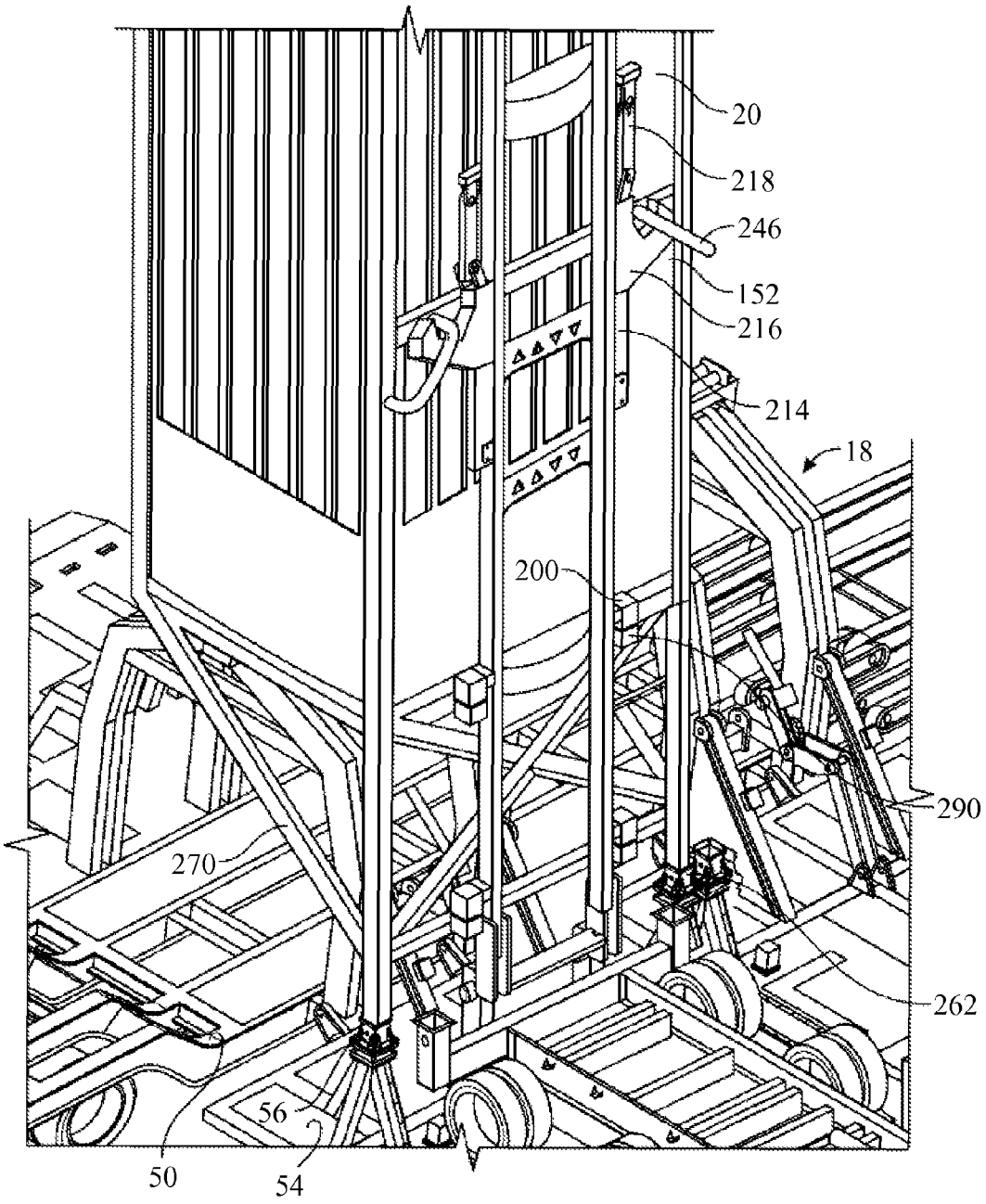
FIG. 17 is a perspective view of the apparatus shown in FIG. 14 in another stage of operation.
Figure 18:
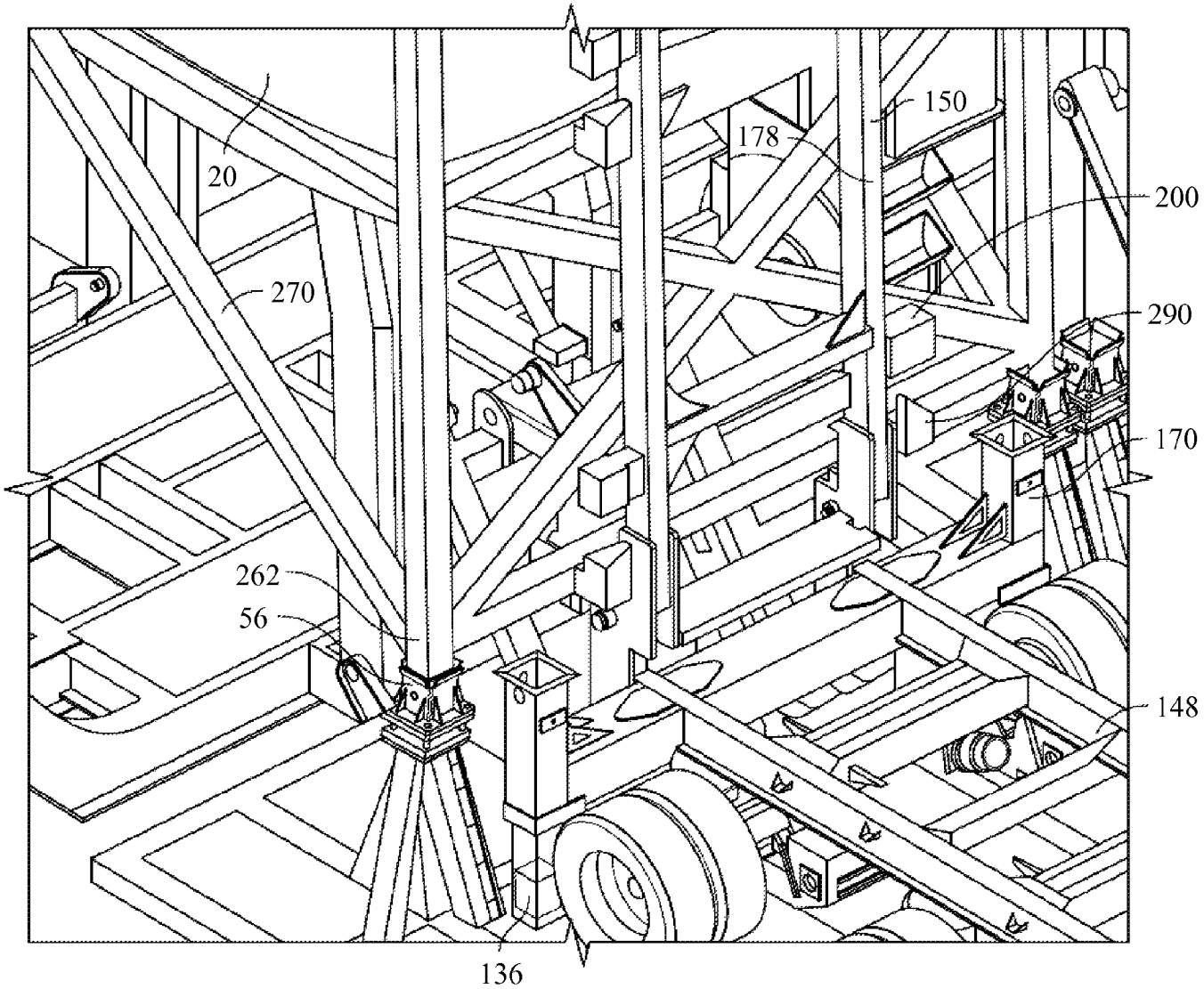
FIG. 18 is a perspective view of a portion of the apparatus shown in FIG. 17.

The one or more engagement structures 216 of the positioning assembly 152 may then be moved to place the modular silo 20 onto the MSS 18, as shown in FIGS. 17 and 18. For example, the actuators 218 of the positioning assembly 152 may be extended, thereby lowering the modular silo 20 relative to the lift structure 178. The lower ends of the silo frame 242 (e.g., the lower ends of the struts 261 and 262) may thus be inserted into the corresponding silo connectors 56. One or more pins and/or other locking devices (not shown) may then be inserted through the silo connectors 56 and the lower ends of the silo frame 242 to retain the lower ends of the silo frame 242 in the corresponding silo connectors 56. Lowering the modular silo 20 relative to the lift structure 178 may also engage the connectors 44 of the frame structure 52 with corresponding portions of the modular silo 20. Such engagement may be substantially automatic, or may be aided via utilization of a tool (e.g., a wrench), locking device, and/or other means.

Figure 19:
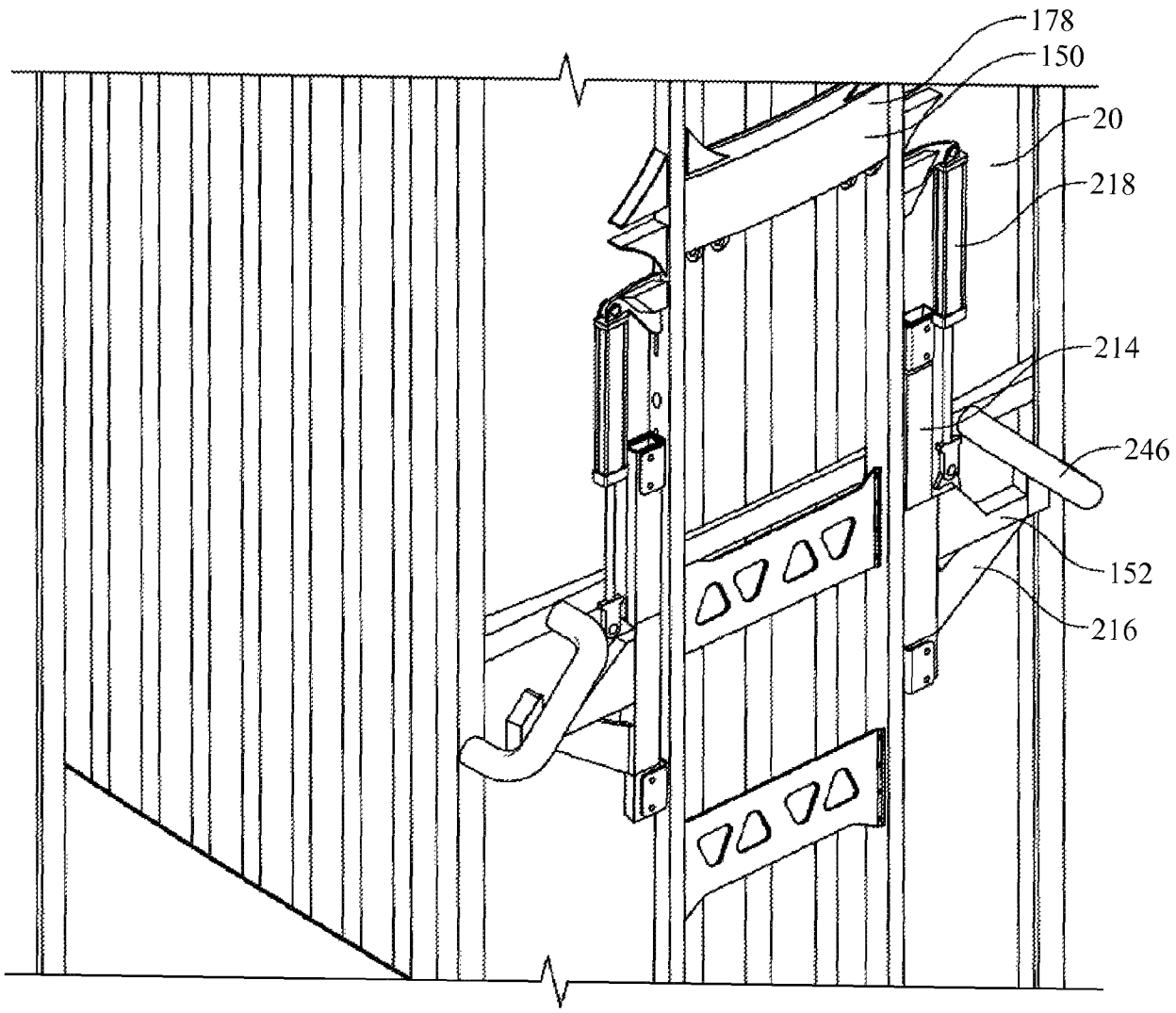
FIG. 19 is a perspective view of a portion of the apparatus shown in FIG. 17 in another stage of operation.

The modular silo 20 may then be disengaged from the lift structure 178. For example, the actuators 218 of the positioning assembly 152 may be further extended, thereby disengaging the projections 223 of the engagement structures 216 from the lift features 246 of the modular silo 20, as shown in FIG. 19. Such action may also disengage the first retaining structures 200 of the mobile erector assembly 146 from the corresponding second retaining structures 290 of the modular silo 20.

Figure 20:
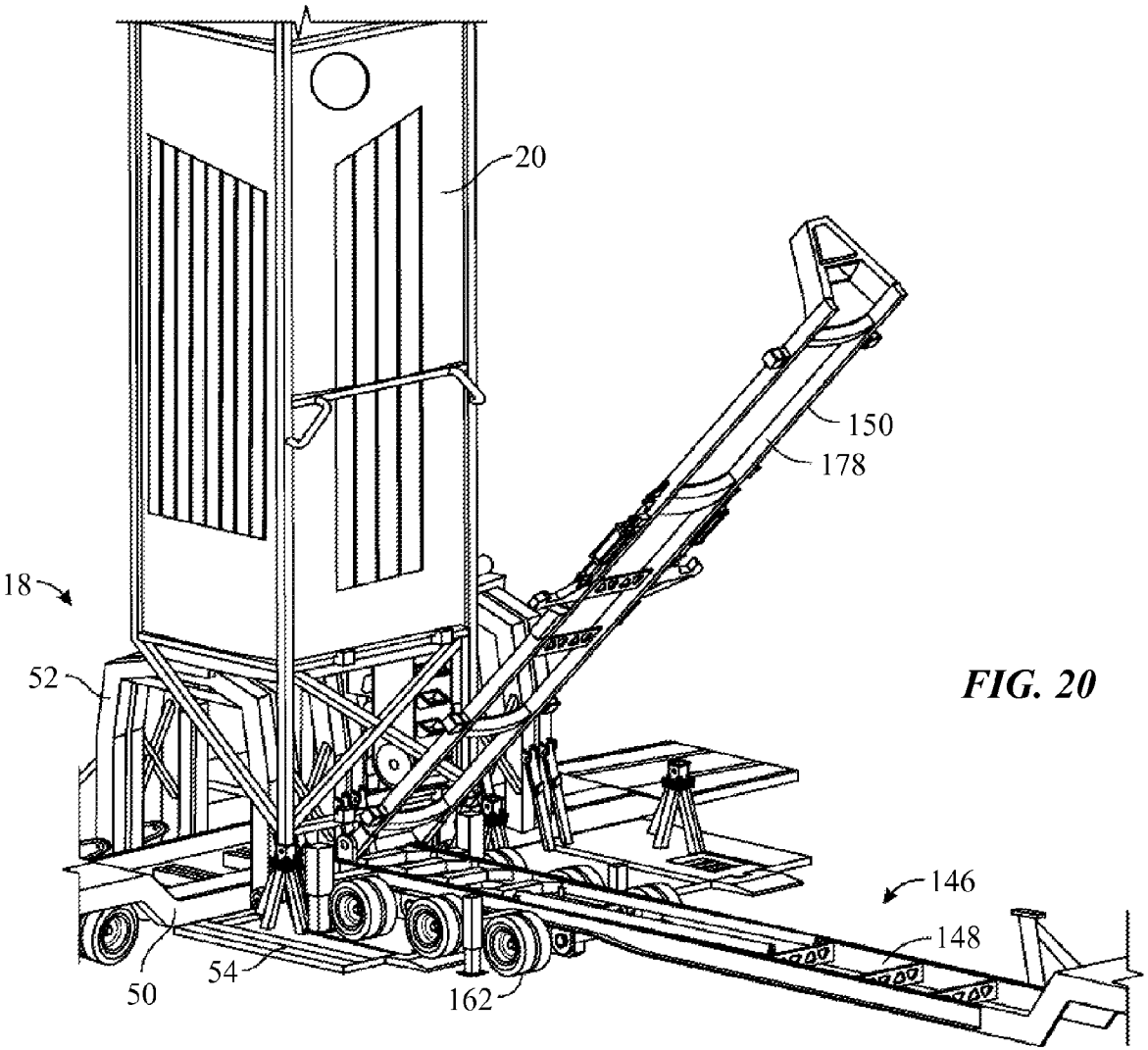
FIG. 20 is a perspective view of the apparatus shown in FIG. 14 in another stage of operation.
Figure 21:
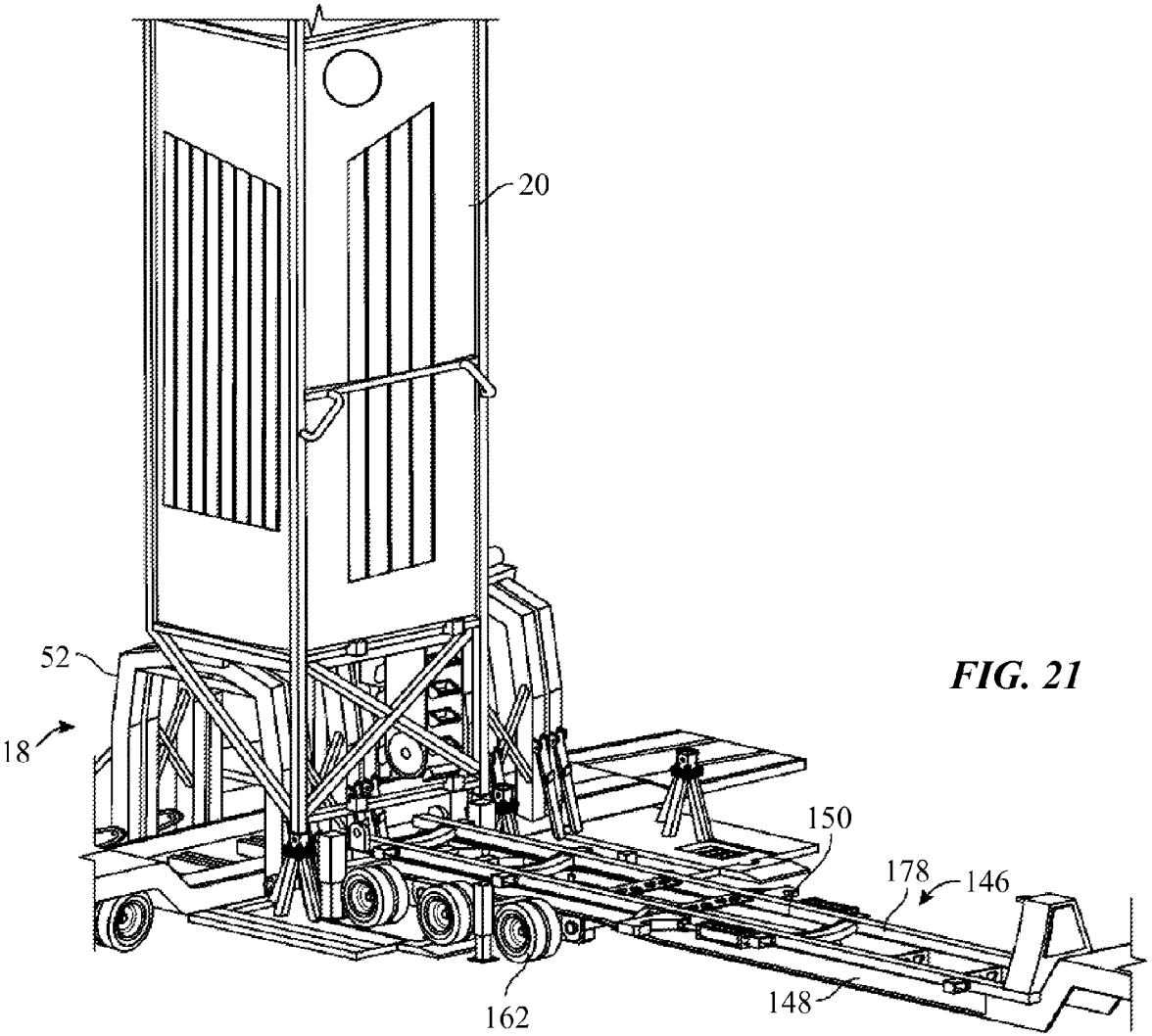
FIG. 21 is a perspective view of a portion of the apparatus shown in FIG. 20 in another stage of operation.

The erecting mast 150 may then be lowered from the mounting orientation to the transportation orientation, as shown in FIGS. 20 and 21. For example, the actuator assembly 154 of the erecting mast 150 may be retracted, thereby rotating the erecting mast 150, without the modular silo 20, downward toward the chassis 148. The chassis 148 may then be removed from the extendable base 76, 78, such as by driving away a truck attached to the chassis 148.

In view of the entirety of the present disclosure, including the figures and the claims, a person having ordinary skill in the art should readily recognize that the present disclosure introduces a mobile support structure (MSS), comprising: a trailer-mounted support base; a frame structure connected to and extending above the support base to define a plurality of silo-receiving regions each configured to receive a corresponding one of a plurality of modular silos; an extendable base moveable between a transportation configuration and a support configuration; and a plurality of silo connectors each disposed on the extendable base and operable to couple with a corresponding one of the plurality of modular silos. The MSS may be within predetermined size limits for transportation on public roads and highways when the extendable base is in the transportation configuration but not when the extendable base is in the support configuration.

The extendable base may comprise first and second extendable bases disposed on first and second sides of the support base, respectively, wherein the first and second extendable bases may each be rotatable from a substantially vertical orientation in the transportation configuration to a substantially horizontal orientation in the support configuration. In such implementations, among others, the MSS may further comprise first and second actuators operable to selectively move the first and second extendable bases, respectively, between the support configuration and the transportation configuration.

The plurality of silo connectors may be a plurality of first silo connectors, the frame structure may comprise a plurality of frames, and the MSS may further comprise a plurality of second silo connectors each disposed proximate an apex of a corresponding one of the plurality of frames and operable to couple with a corresponding one of the plurality of modular silos. In such implementations, among others, two of the plurality of second silo connectors may be connected to the apex of each of the plurality of frames such that each of the plurality of frames partially supports two of the plurality of modular silos.

The extendable base may comprise a plurality of chassis guides each corresponding to a wheel clearance of an oilfield material container transport assembly operable to transport and mount one of the plurality of modular silos to the MSS.

The extendable base may comprise a plurality of chassis alignment posts each positioned to engage an alignment member of an oilfield material container transport assembly operable to transport and mount one of the plurality of modular silos to the MSS, thereby aligning the chassis relative to the frame structure.

The present disclosure also introduces an apparatus comprising: a mobile chassis; a lift structure coupled to the chassis and rotatable between a transportation orientation and a mounting orientation while detachably engaged with a modular silo; and a positioning assembly carried by the lift structure and comprising: an engagement structure movable between a first position and a second position while detachably engaged with the modular silo; and an actuator coupled between the lift structure and the engagement structure and operable to move the engagement structure between the first position and the second position, thereby moving the modular silo engaged by the engagement structure, including lifting the modular silo away from the chassis when the lift structure is in the mounting orientation. The apparatus may be within predetermined size limits for transportation on public roads and highways when the lift structure and the modular silo are in the transportation orientation but not when the lift structure and the modular silo are in the mounting orientation.

The lift structure may be substantially parallel to the chassis when in the transportation orientation, and the lift structure may be substantially perpendicular to the chassis when in the mounting orientation.

The lift structure may comprise a plurality of first retaining structures each detachably engaging with a corresponding one of a plurality of second retaining structures of the modular silo.

The positioning assembly may comprise first and second opposing and substantially parallel rails coupled to, and disposed outwardly relatively to, first and second opposing and substantially parallel sides of the lift structure, respectively. In such implementations, among others, the engagement structure may comprise a first engagement structure slidably coupled to the first rail and a second engagement structure slidably coupled to the second rail, and the actuator may comprise: a first actuator operably coupled between the first side of the lift structure and the first engagement structure to move the first engagement structure along the first rail; and a second actuator operably coupled between the second side of the lift structure and the second engagement structure to move the second engagement structure along the second rail.

The modular silo may comprise first and second lift features, and the first and second engagement structures may each comprise an angled surface operable in conjunction with a corresponding one of the first and second lift features to align the modular silo relative to the lift structure.

The apparatus may further comprise a plurality of wheels operably coupled to the chassis to transport the chassis and, thus, the lift structure, the positioning assembly, and the modular silo detachably engaged with the engagement structure.

The present disclosure also introduces a method comprising: coupling a modular silo to a mobile erector assembly of an oilfield material container transport assembly in a transportation orientation; then aligning the mobile erector assembly relative to a mobile support structure (MSS) by engaging an alignment member of the mobile erector assembly with a chassis alignment post of the MSS; and then operating the mobile erector assembly to move the modular silo from the transportation orientation to a mounting orientation and couple the modular silo to the MSS.

Coupling the modular silo to the mobile erector assembly may comprise detachably engaging each of a plurality of first retaining structures of the mobile erector assembly with a corresponding one of a plurality of second retaining structures of the modular silo. Coupling the modular silo to the mobile erector assembly may comprise detachably engaging a lift feature of the modular silo with an engagement structure of the mobile erector assembly, including thereby aligning the modular silo with the mobile erector assembly.

Aligning the mobile erector assembly relative to the MSS may comprise aligning a plurality of wheels of the mobile erector assembly relative to a corresponding plurality of chassis guides of the MSS.

Operating the mobile erector assembly to move the modular silo from the transportation orientation to the mounting orientation may comprise operating an actuator assembly of the mobile erector assembly to rotate the modular silo relative to a chassis of the mobile erector assembly along a substantially arc-shaped path.

The modular silo may comprise first and second lift features, and the mobile erector assembly may comprise: a mobile chassis; a lift structure coupled to the chassis and rotatable between a transportation orientation and a mounting orientation while engaged with the modular silo; first and second engagement structures each movable between a first position and a second position while engaged with the modular silo, and each comprising an angled surface operable in conjunction with a corresponding one of the first and second lift features to align the modular silo relative to the lift structure; and first and second actuators each coupled between the lift structure and a corresponding one of the first and second engagement structures. In such implementations, among others, operating the mobile erector assembly to move the modular silo from the transportation orientation to the mounting orientation and then coupling the modular silo to the MSS may include operating the first and second actuators to position the modular silo relative to a plurality of silo connectors of the MSS. Such method(s) may further comprise operating the first and second actuators to disengage the first and second engagement structures from the first and second lift features.

The MSS may comprise a support base, a frame structure connected to and extending above the support base to define a plurality of silo-receiving regions each configured to receive a corresponding one of a plurality of modular silos, an extendable base moveable between a transportation configuration and a support configuration, and a plurality of silo connectors each disposed on the extendable base and operable to couple with a corresponding one of the plurality of modular silos. In such implementations, among others, coupling the modular silo to the MSS may comprise coupling the modular silo to two of the plurality of silo connectors. Moreover, the plurality of silo connectors may be a plurality of first silo connectors, the frame structure may comprise a plurality of frames, the MSS may comprise a plurality of second silo connectors each disposed proximate an apex of a corresponding one of the plurality of frames, and coupling the modular silo to the MSS may comprise coupling the modular silo to two of the plurality of second silo connectors.

The foregoing outlines features of several embodiments so that a person having ordinary skill in the art may better understand the aspects of the present disclosure. A person having ordinary skill in the art should appreciate that they may readily use the present disclosure as a basis for designing or modifying other processes and structures for carrying out the same functions and/or achieving the same benefits of the embodiments introduced herein. A person having ordinary skill in the art should also realize that such equivalent constructions do not depart from the spirit and scope of the present disclosure, and that they may make various changes, substitutions and alterations herein without departing from the spirit and scope of the present disclosure.

The Abstract at the end of this disclosure is provided to permit the reader to quickly ascertain the nature of the technical disclosure. It is submitted with the understanding that it will not be used to interpret or limit the scope or meaning of the claims.

What is claimed is:

1. A method, comprising:

providing a mobile support structure (MSS), wherein the MSS comprises a support base (50), a frame structure (52) connected to and extending above the support base to define a plurality of silo-receiving regions (72) each configured to receive a corresponding one of a plurality of modular silos (20), an extendable base (54) moveable between a transportation configuration and a support configuration, and a plurality of silo connectors (56) each disposed on the extendable base and operable to couple with a corresponding one of the plurality of modular silos;

coupling the modular silo (20) to a mobile erector assembly (146) of an oilfield material container transport assembly (144) in a transportation orientation;

aligning the mobile erector assembly relative to the mobile support structure (MSS) (18) by engaging an alignment member (170) of the mobile erector assembly with a chassis alignment post (136) of the MSS (18);

operating the mobile erector assembly to move the modular silo from the transportation orientation to a mounting orientation; and coupling the modular silo to the MSS.

2. The method of claim 1 wherein coupling the modular silo to the mobile erector assembly comprises detachably engaging each of a plurality of first retaining structures (200) of the mobile erector assembly with a corresponding one of a plurality of second retaining structures (290) of the modular silo.

3. The method of claim 1 wherein coupling the modular silo to the mobile erector assembly comprises detachably engaging a lift feature (246) of the modular silo with an engagement structure (216) of the mobile erector assembly, including thereby aligning the modular silo with the mobile erector assembly.

4. The method of claim 1 wherein aligning the mobile erector assembly relative to the MSS further comprises aligning a plurality of wheels (162) of the mobile erector assembly relative to a corresponding plurality of chassis guides (130) of the MSS.

5. The method of claim 1 wherein operating the mobile erector assembly to move the modular silo from the transportation orientation to the mounting orientation comprises operating an actuator assembly (154) of the mobile erector assembly to rotate the modular silo relative to a chassis (148) of the mobile erector assembly along a substantially arc-shaped path (196).

6. The method of claim 1 wherein:

the modular silo comprises first and second lift features (246);

the mobile erector assembly comprises:

a mobile chassis (148);

a lift structure (178) coupled to the chassis and rotatable between a transportation orientation and a mounting orientation while engaged with the modular silo;

first and second engagement structures (216) each movable between a first position and a second position while engaged with the modular silo, and each comprising an angled surface (228) operable in conjunction with a corresponding one of the first and second lift features to align the modular silo relative to the lift structure; and first and second actuators (218) each coupled between the lift structure and a corresponding one of the first and second engagement structures; and operating the mobile erector assembly to move the modular silo from the transportation orientation to the mounting orientation and then couple the modular silo to the MSS includes operating the first and second actuators to position the modular silo relative to a plurality of silo connectors (44, 56) of the MSS.

7. The method of claim 6 further comprising operating the first and second actuators to disengage the first and second engagement structures from the first and second lift features.

8. The method of claim 1 further comprising coupling the modular silo to the MSS comprises coupling the modular silo to two of the plurality of silo connectors.

9. The method of claim 8 wherein:

the plurality of silo connectors is a plurality of first silo connectors;

the frame structure comprises a plurality of frames (91-94);

the MSS comprises a plurality of second silo connectors (44) each disposed proximate an apex (104) of a corresponding one of the plurality of frames; and coupling the modular silo to the MSS comprises coupling the modular silo to two of the plurality of second silo connectors.

10. The method of claim 1 further comprising performing a fracturing operation utilizing the modular silo.

* * * * *